US005395732A

United States Patent [19]

Katoh et al.

[11] Patent Number: 5,395,732

[45] Date of Patent: * Mar. 7, 1995

[54] SILVER HALIDE PHOTOGRAPHIC MATERIALS

[75] Inventors: Kazunobu Katoh; Morio Yagihara; Takahiro Goto, all of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 893,945

[22] Filed: Jun. 4, 1992

Related U.S. Application Data

[63] Continuation of Ser. No. 515,994, Apr. 27, 1990, abandoned.

[30] Foreign Application Priority Data

Apr. 27, 1989 [JP] Japan ..... 1-108215
Sep. 18, 1989 [JP] Japan ..... 1-240967

[51] Int. Cl.[6] ..... G03C 1/06

[52] U.S. Cl. ..... 430/264; 430/223; 430/502; 430/544; 430/566; 430/598; 430/957

[58] Field of Search ..... 430/222, 223, 264, 572, 430/566, 598, 544, 546, 957, 502

[56] References Cited

U.S. PATENT DOCUMENTS

| | | | |
|---|---|---|---|
| 4,684,604 | 8/1987 | Harder | 430/375 |
| 4,737,442 | 4/1988 | Yagihara et al. | 430/264 |
| 4,914,002 | 4/1990 | Inoue et al. | 430/264 |
| 5,124,231 | 6/1992 | Sakai et al. | 430/264 |
| 5,155,006 | 10/1992 | Goto et al. | 430/264 |
| 5,190,850 | 3/1993 | Sakai et al. | 430/264 |
| 5,230,983 | 7/1993 | Inoue et al. | 430/264 |
| 5,273,859 | 12/1993 | Katoh et al. | 430/264 |

FOREIGN PATENT DOCUMENTS

| | | | |
|---|---|---|---|
| 62-245263 | 10/1987 | Japan | G03C 7/26 |
| 63-046450 | 2/1988 | Japan | G03C 7/26 |
| 1072140 | 3/1989 | Japan | 430/569 |

OTHER PUBLICATIONS

European Search Report, Nov. 30, 1990, EP 90 10 7991.
Patent Abstracts of Japan, vol. 13, No. 291, (P-893) (3639), Jul. 6, 1989.

*Primary Examiner*—Janis L. Dote
*Attorney, Agent, or Firm*—Sughrue, Mion, Zinn, Macpeak & Seas

[57] ABSTRACT

A silver halide photographic material is disclosed, which comprises (a) at least one light-sensitive silver halide emulsion layer containing a hydrazine derivative and (b) a hydrophilic colloid layer which is different from the light-sensitive silver halide emulsion layer and which contains a redox compound capable of releasing a development inhibitor as a result of oxidation.

16 Claims, 1 Drawing Sheet

SILVER HALIDE PHOTOGRAPHIC MATERIALS

This is a continuation of application Ser. No. 07/515,994, filed Apr. 17, 1990, now abandoned.

FIELD OF THE INVENTION

This invention concerns silver halide photographic materials and a method for forming superhigh contrast negative images in which these materials are used. More precisely, the invention concerns the superhigh contrast negative type silver halide photographic materials which are used in photomechanical processes.

BACKGROUND OF THE INVENTION

Photographic materials which have good original reproduction characteristics, stable development baths and simple replenishment are some of the requirements in the field of photomechanical process for dealing with the diversity and complexity of printed matter.

Original documents in line work processes are made with a paste-up of photoset text, hand written text, illustrations and screened photographs. Hence, the original documents comprise a mixture of images of different densities and line widths, and there is a consequent demand for process cameras, photographic materials and methods of image formation which reproduce these original documents with a good finish. Further, enlargement (spread) or reduction (choke) of screened photographs is widely used in plate making for catalogues and posters. In plate making where screen dots are enlarged, the number of lines becomes coarser and blurred dot reproduction occurs. With reduction, the number of lines per inch is greater than on the original document and finer dots are reproduced. Hence, there is a demand for a method of forming images which has a wider latitude in maintaining the reproducibility of the original screen gradation.

Halogen lamps or xenon lamps are used as the light source for process cameras. Photographic materials are normally ortho sensitized to achieve photographic sensitivity to these light sources. However, ortho sensitized photographic materials are greatly affected by chromatic aberration of lenses and this aberration is likely to result in a deterioration of picture quality. This deterioration is more pronounced with xenon lamp light sources.

Known systems developed in response to the demand for wider latitudes include those in which line images or dot images (in which there is a clear distinction between image parts and non-image parts and which have high contrast and high black densities) are obtained by processing lith type silver halide photographic materials comprising silver chlorobromides (in which the silver chloride content is at least 50 mol %) in hydroquinone developers containing a very low effective concentration of sulfite ion (normally not more than 0.1 mol/-liter). However, with these methods the developer is very unstable with respect to aerial oxidation because of the low sulfite concentration, though various endeavors and devices have been used to maintain a stable bath activity. Further, processing is very slow and operational efficiency is reduced.

Consequently, a demand has arisen for image forming systems in which the instability of image formation (caused by development methods such as (lith development systems) are overcome, with which development is carried out in processing baths having a good storage stability, and with which superhigh contrast photographic characteristics can be realized. In these systems superhigh contrast images of a gamma value exceeding 10 are formed by processing surface latent image type silver halide photographic materials to which specified acylhydrazine compounds have been added. Processing is performed in development baths of a pH from 11.0 to 12.3, containing at least 0.15 mol/liter of sulfite preservative, and having good storage stability, suggested in U.S. Pat. Nos. 4,166,742, 4,168,977, 4,221,857, 4,224,401, 4,243,739, 4,272,606 and 4,311,781. A distinguishing feature of these novel image forming systems is that, whereas only silver chlorobromides which had a high silver chloride content could be used in the conventional superhigh contrast image forming systems, silver iodobromides and silver chloroiodobromides can also be used in these novel systems.

The above mentioned image forming systems provide excellent sharp screen dot quality, processing stability, processing speed and original reproduction characteristics. But systems which provide still better original reproduction characteristics have become desirable for dealing with the diversity of printed matter.

Attempts have been made to widen the gradation reproduction range by using photographic materials which contain redox compounds which release photographically useful groups on oxidation as shown in JP-A-61-213847 and U.S. Pat. No. 4,684,604. However, with superhigh contrast systems in which hydrazine derivatives are used, the hydrazine compounds have the adverse effect interfering with the hardening of contrast and the required characteristics cannot be realized.

SUMMARY OF THE INVENTION

One object of the present invention is to provide photographic materials for photomechanical process, by which high contrast images can be obtained using highly stable developers.

A second object of the present invention is to provide photographic materials for photomechanical process which have a wide dot gradation.

A third object of the present invention is to provide photographic materials for photomechanical process, which have a wide dot gradation using high contrast sensitive materials in which hydrazine nucleating agents are used.

These and other objects of the present invention have been realized by means of a silver halide photographic material which comprises (a) at least one light-sensitive silver halide emulsion layer containing a hydrazine derivative and (b) a hydrophilic colloid layer which is different from the light-sensitive silver halide emulsion layer, and which contains a redox compound capable of releasing a development inhibitor as a result of oxidation.

The redox compounds which release development inhibitor as a result of oxidation are described below.

The redox compounds of the present invention include hydroquinones, catechols, naphthohydroquinones, aminophenols, pyrazolidones, hydrazines, hydroxylamines or reductones as the redox group.

The preferred redox compounds are distinguished by having hydrazines as the redox group.

Moreover, the most preferred of the aforementioned redox groups are within compounds represented by the general formula (I) below.

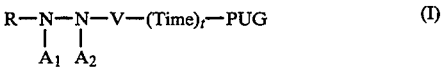

(I)

In this formula, both $A_1$ and $A_2$ represent hydrogen atoms, or one represents a hydrogen atom and the other represents a sulfinic acid residual group or

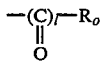

(wherein $R_0$ represents an alkyl group, an alkenyl group, an aryl group, an alkoxy group or an aryloxy group, and l represents 1 or 2). Time represents a divalent linking group, and t represents 0 or 1. PUG (photographically useful group) represents a development inhibitor. V represents a carbonyl group,

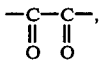

a sulfonyl group, a sulfoxy group,

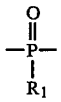

(wherein $R_1$ represents alkoxy group or an aryloxy group), an iminomethylene group or a thiocarbonyl group. R represents an aliphatic group, an aromatic group or a heterocyclic group.

BRIEF DESCRIPTION OF THE DRAWINGS

In FIG. 1(*a*) represents a transparent or translucent paste up base; 1(*b*) represents a line drawing original (in which the black parts indicate the lines); 1(*c*) represents a transparent or translucent paste up base; 1(*d*) represents a screen dot original (in which the black parts indicate the dots); and 1(*e*) represents a light-sensitive material for contact work (in which the shaded part indicates the light-sensitive layer).

DETAILED DESCRIPTION OF THE INVENTION

Figures 1A, 1B, 1C, 1D, 1E:
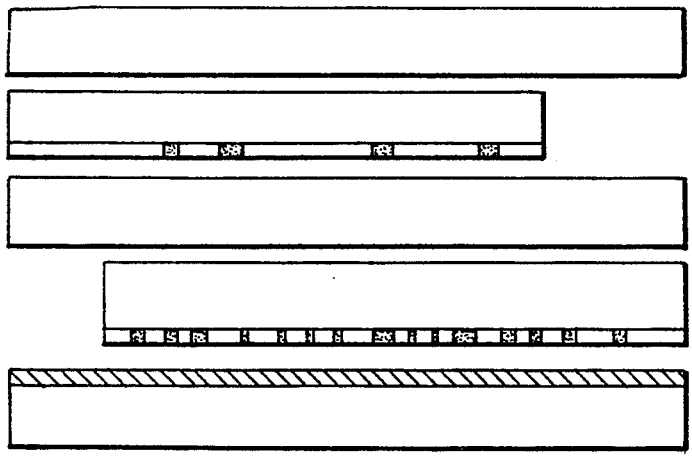
FIG. 1 shows the construction used during exposure when carrying out letter image formation using superimposition.

General formula (I) is described in detail below.

$A_1$ and $A_2$ in general formula (I) are hydrogen atoms, alkylsulfonyl or arylsulfonyl groups which do not have more than 20 carbon atoms (preferably phenylsulfonyl groups or substituted phenylsulfonyl groups in which the sum of the Hammett's substituent constants is at least −0.5),

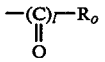

(wherein $R_0$ is preferably a linear chain, branched or cyclic alkyl group, an alkenyl group or an aryl group (preferably a phenyl group or a substituted phenyl group of which the sum of the Hammett substituent group constants is at least −0.5) which does not have more than 30 carbon atoms, an alkoxy group which does not have more than 30 carbon atoms (for example, ethoxy), or an aryloxy group which does not have more than 30 carbon atoms (which preferably has a single ring). These groups may have substituent groups, examples of which are indicated below. For example, the substituent groups may be alkyl groups, aralkyl groups, alkenyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo or carboxyl groups, aryloxycarbonyl groups, acyl groups, alkoxycarbonyl groups, acyloxy groups, carboxamido groups, sulfonamido groups and nitro groups. And these substituent groups may also have substituent groups. Specific examples of sulfinic acid residual groups which can be represented by $A_1$ and $A_2$ include those disclosed in U.S. Pat. No. 4,478,928.

Furthermore, $A_1$ may be joined with -(Time)$_t$- as described hereinafter to form a ring.

$A_1$ and $A_2$ are most preferably hydrogen atoms.

Time represents a divalent linking group and has a timing adjustment function. Moreover, t represents 0 or 1, and when t=0, the PUG is bonded directly to V.

The divalent linking groups represented by Time are groups which release PUG via a simple stage or multiple stage reaction from the Time-PUG moiety which in turn is released from the oxidized form of the parent redox nucleus.

Examples of divalent linking groups which can be represented by Time include: (1) those in which a PUG is released via an intramolecular ring closing reaction of a p-nitrophenoxy derivative as disclosed, for example, in U.S. Pat. No. 4,248,962 (JP-A-54-145135); (2) those in which a PUG is released via an intramolecular ring closing reaction after ring cleavage as disclosed, for example, in U.S. Pat. No. 4,310,612 (JP-A-55-53330); (3) those in which a PUG is released with the formation of an acid anhydride by means of the intramolecular ring closing reaction of the carboxyl group of a monoester of succinic acid or a derivative thereof as disclosed, for example, in U.S. Pat. Nos. 4,330,617, 4,446,216 and 4,483,919, and JP-A-59-121,328; (4) those in which a PUG is released with the formation of a quinomonomethane or a derivative thereof by means of an electron transfer via conjugated double bonds of an aryloxy group or a heterocyclic oxy group as disclosed, for example, in U.S. Pat. Nos. 4,409,323 and 4,421,845, *Research Disclosure*, No. 21228 (December, 1981), U.S. Pat. No. 4,416,977 (JP-A-57-135944), JP-A-58-209736 and JP-A-58-209738; (5) those in which a PUG is released from the γ-position of an enamine by means of electron transfer on the part of a nitrogen containing heterocyclic enamine structure as disclosed, for example, in U.S. Pat. No. 4,420,554 (JP-A-57-136640), JP-A-57-135945, JP-A-57-188035, JP-A-58-98728 and JP-A-58-209737; (6) those in which a PUG is released by means of an intramolecular ring closing reaction of an oxy group which is formed by electron transfer to a carbonyl group which is conjugated with the nitrogen atom of a nitrogen containing heterocyclic ring as disclosed in JP-A-57-56837; (7) those in which a PUG is released with the formation of an aldehyde as disclosed, for example, in U.S. Pat. No. 4,146,396 (JP-A-52-90932), JP-A-59-93442, and JP-A-59-75475; (8) those in which a PUG is released with the decarbonization of a carboxyl group as disclosed in GB 1531927 (JP-A-51-

146828), JP-A-57-179842 and JP-A-59-104641; (9) those which have a —O—COOCR$_a$R$_b$—PUG structure (wherein R$_a$ and R$_b$ each is a monovalent group) and which release a PUG via the reaction of the aldehyde following decarboxylation; (10) those in which a PUG is released with the formation of an isocyanate as disclosed in U.S. Pat. No. 4,546,073 (JP-A-60-7429); and (11) those in which a PUG is released by means of a coupling reaction with the oxidized form of a color developing agent as disclosed, for example, in U.S. Pat. No. 4,438,193. (The term "JP-A" as used herein means an "unexamined published Japanese patent application".)

Moreover, specific examples of divalent linking groups which can be represented by Time are described in detail, for example, in JP-A-61-236549 and JP-A-1-269936, and specific preferred examples are indicated below.

Here, (*) signifies the position at which, in general formula (I), -(Time)$_t$-PUG is bonded to V, and (*)(*) signifies the position to which the PUG is bonded.

T-(1)

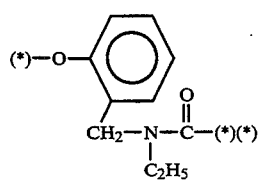

T-(2)

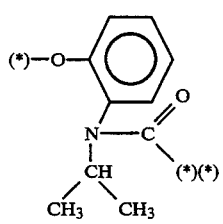

T-(3)

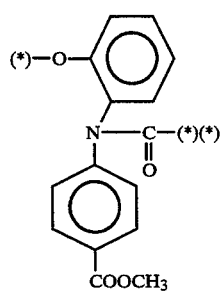

T-(4)

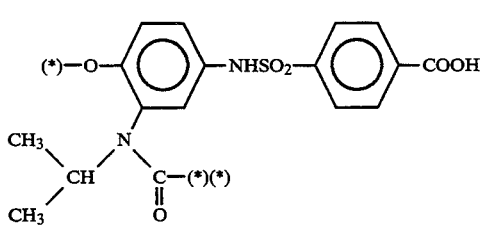

T-(5)

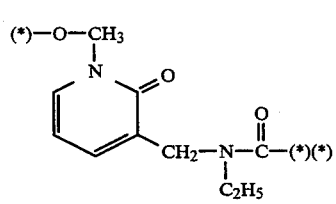

-continued

T-(6)

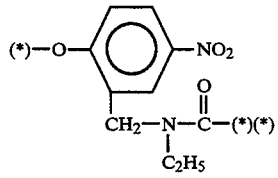

T-(7)

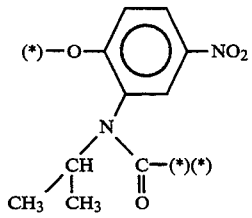

T-(8)

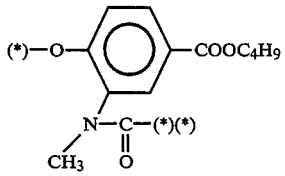

T-(9)

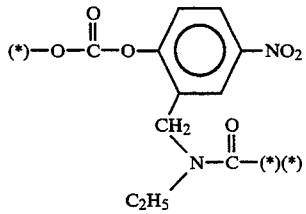

T-(10)

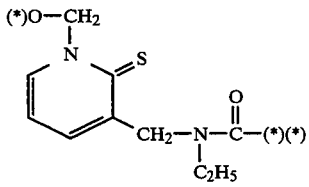

T-(11)

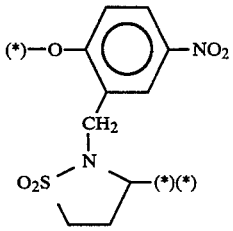

T-(12)

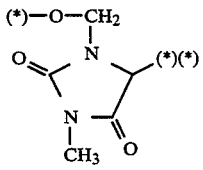

-continued
T-(13)
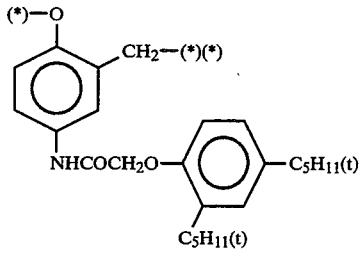
T-(14)
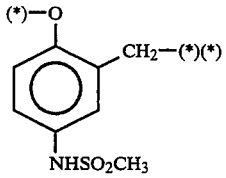
T-(15)
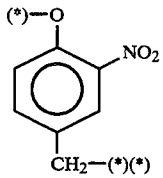
T-(16)
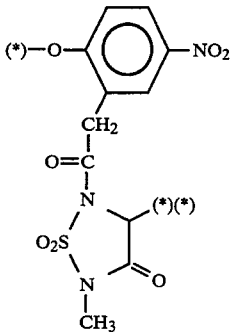
T-(17)
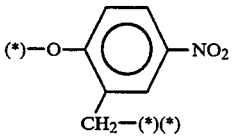
T-(18)
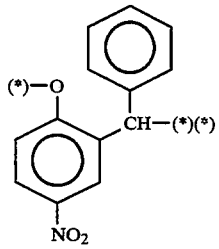
T-(19)
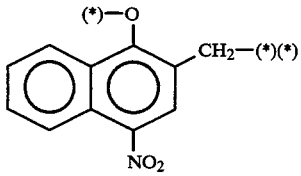
-continued
T-(20)
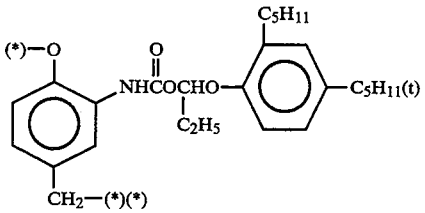
T-(21)
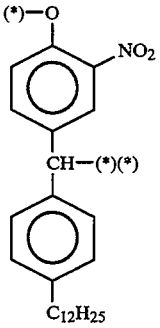
T-(22)
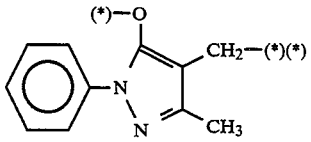
T-(23)
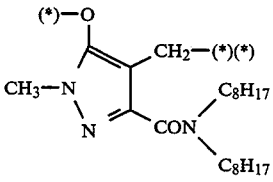
T-(24)
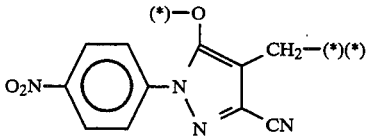
T-(25)
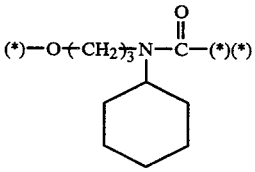
T-(26)
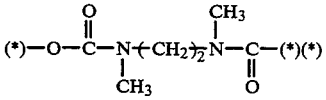
T-(27)
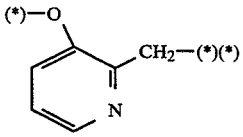

-continued

T-(28)

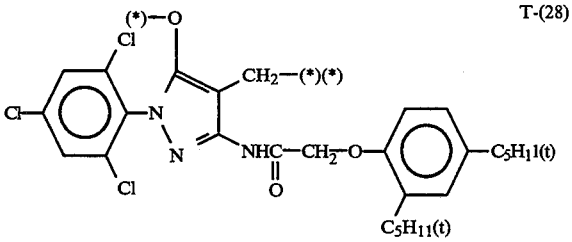

T-(29)

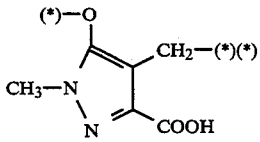

T-(30)

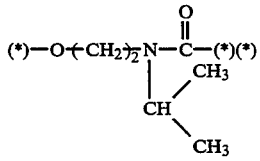

T-(31)

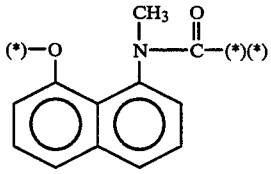

T-(32)

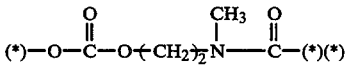

T-(33)

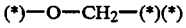

T-(34)

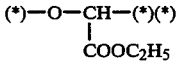

T-(35)

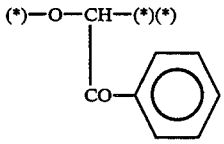

T-(36)

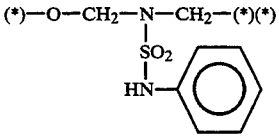

T-(37)

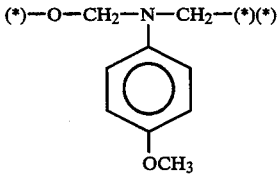

T-(38)

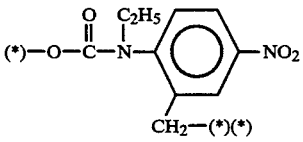

-continued

T-(39)

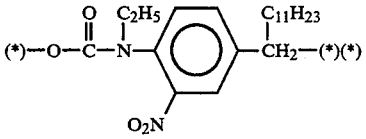

T-(40)

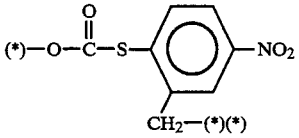

T-(41)

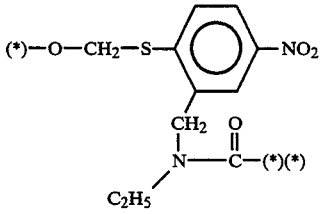

T-(42)

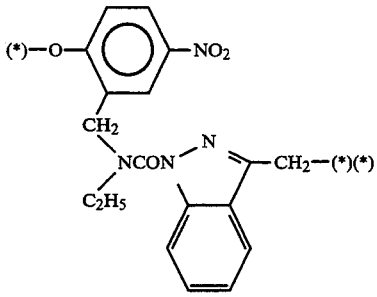

PUG represents a group which, either above or in combination with $(Time)_t$ has a development inhibiting action.

Development inhibitors represented by PUG or $(Time)_t$-PUG are known development inhibitors which have a hetero atom and which are bonded via a hetero atom, and they have been described, for example, by C. E. K. Mees and T. H. James in *The Theory of Photographic Processes*, Third Edition, 1966, pages 344–346, published by Macmillan. Categories of inhibitors include mercaptotetrazoles, mercaptotriazoles, mercaptoimidazoles, mercaptopyrimidines, mercaptobenzimidazoles, mercaptobenzthiazoles, mercaptobenzoxazoles, mercaptothiadiazoles, benztriazoles, benzimidazoles, indazoles, adenines, guanines, tetrazoles, tetraazaindenes, triazaindenes and mercaptoaryls.

The development inhibitors represented by PUG may be substituted. Some examples of substituent groups are indicated below, and these groups may be further substituted with substituent groups.

The substituent groups may be alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, nitro groups, sulfo groups, aryloxycarbonyl groups, acyl groups, alkoxycarbonyl groups, acyloxy groups, carboxamido groups, sulfonamido groups, carboxyl groups, sulfoxy groups, phosphono groups, phosphinyl groups and phosphoric acid amido groups.

The preferred substituent groups are nitro groups, sulfo groups, carboxyl groups, sulfamoyl groups, phosphono groups, phosphinyl groups and sulfonamido groups.

The principal development inhibitors are indicated below:

1. Mercaptotetrazole Derivatives:
(1) 1-Phenyl-5-mercaptotetrazole
(2) 1-(4-Hydroxyphenyl)-5-mercaptotetrazole
(3) 4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazol)ethyltrimethylammonium chloride
(34) 1-(3-Phenoxycarbonylphenyl)-5-mercaptotetrazole
(35) 1-(3-Maleineimidophenyl)-5-mercaptotetrazole 2. Mercaptotriazole Derivatives:
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-2-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives:
(1) 1-Phenyl-2-mercaptoimidazole
(2) 1,5-Diphenyl-2-mercaptoimidazole
(3) 1-(4-Carboxyphenyl)-2-mercaptoimidazole
1-(4-Hexylcarbamoyl)-2-mercaptoimidazole
(5 ) 1-(3-Nitrophenyl)-2-mercaptoimidazole
(6 ) 1-(4-Sulfophenyl)-2-mercaptoimidazole 4. Mercaptopyrimidine Derivatives:
(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives:
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives:
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzthiazole Derivatives:
(1) 2-Mercaptobenzthiazole
(2) 5-nitro-2-mercaptobenzthiazole
(3) 5-Carboxy-2-mercaptobenzthiazole
(4) 5-Sulfo-2-mercaptobenzthiazole 8. Mercaptobenzoxazole Derivatives:
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benztriazole Derivatives:
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Derivatives:
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Derivatives:
(1) 5-Nitroindazole
(2) 6-Nitroindazole (3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole
2. Tetrazole Derivatives:
(1) 5-(4-Nitrophenyl)tetrazole
(2) 5-Phenyltetrazole
(3) 5-(3-Carboxyphenyl)tetrazole
13. Tetrazaindene Derivatives:
(1) 4-Hydroxy-6-methyl-5-nitro-1,3,3a,7-tetra-azaindene
(2) 4-Mercapto-6-methyl-5-nitro-1,3,3a,7-tetra-azaindene
14. Mercaptoaryl Derivatives:
(1) 4-Nitrothiophenol
(2) Thiophenol
(3) 2-Carboxythiophenol V represents a carbonyl group,

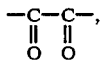

a sulfonyl group, a sulfoxy group,

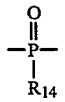

(where $R_{14}$ represents an alkoxy or aryloxy group having 1 to 30 carbon atoms), an iminomethylene group or a thiocarbonyl group, and V is preferably a carbonyl group.

The aliphatic groups represented by R are linear chain, branched or cyclic alkyl groups, linear chain, branched or cyclic alkenyl groups or alkynyl groups. Groups which have 1 to 30 carbon atoms are preferred, and those which have 1 to 20 carbon atoms are the most desirable. A branched alkyl group may be cyclized to form a saturated heterocyclic ring which contains one or more hetero atoms.

Examples of the aliphatic group include: methyl, t-butyl, n-octyl, t-octyl, cyclohexyl, hexenyl, pyrrolidyl, tetrahydrofuryl and n-dodecyl.

The aromatic groups are single ringed or double ringed aryl groups, for example phenyl and naphthyl.

The heterocyclic groups have three to ten members. They are saturated or unsaturated heterocyclic rings which contain at least one atom selected from among the N, O and S atoms. Further, they may be single ring compounds or they may form condensed with other aromatic rings or heterocyclic rings. Five or six membered aromatic heterocyclic rings are preferred, examples of which include a pyridine ring, an imidazolyl group, a quinolinyl group, a benzimidazolyl group, a pyrimidinyl group, a pyrazolyl group, an isoquinolinyl group, a benzthiazolyl group and a thiazolyl group.

R may be substituted with substituent groups. Examples of such substituent groups include: alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, aryloxycarbonyl groups, acyl groups, alkoxycarbonyl groups, acyloxy groups, carbonamido groups, sulfonamido groups, carboxy groups and phosphoric acid amido groups. These substituent groups may also be substituted with substituent groups.

Furthermore, R or $-(Time)_t$-PUG in general formula (I) may have incorporated within it a ballast group of the type normally attached to immobile photographically useful additives such as couplers, and a group which promotes the adsorption of the compound represented by the general formula (I) on silver halides.

The ballast groups are organic groups which provide the compound represented by general formula (I) with sufficient molecular weight and which essentially prevent the compound from diffusing into other layers or into the processing baths. They preferably have 8 to 40 carbon atoms. Examples of the ballast groups include alkyl groups, aryl groups, heterocyclic groups, ether groups, thioether groups, amido groups, ureido groups, urethane groups and sulfonamido groups, and combinations of these groups. Ballast groups which have substituted benzene rings are preferred, and ballast groups which have benzene rings substituted with branched alkyl groups are especially preferred.

Specific examples of groups which promote adsorption on silver halides include cyclic thioamido groups such as 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-oxazolin-2-thione, benzimidazolin-2-thione, benzoxazolin-2-thione, benzothiazolin-2-thione, thiotriazine and 1,3-imidazolin-2-thione, chain-like thioamido groups, aliphatic mercapto groups, aromatic mercapto groups, heterocyclic mercapto groups (where there is a nitrogen atom adjacent to the carbon atom to which the —SH group is bonded this is the same as the cyclic thioamido group which it is related tautomerically), groups which have disulfide bonds, five or six membered nitrogen containing heterocyclic groups comprising combinations of nitrogen, oxygen, sulfur and carbon atoms (such as benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene), and heterocyclic quaternary salts (such as benzimidazolium salts).

These adsorption promoting groups may be substituted with appropriate substituent groups, such as those groups mentioned as substituent groups for R.

Specific examples of compounds of general formula (I) of the present invention are indicated below, but the invention is not limited to these examples:

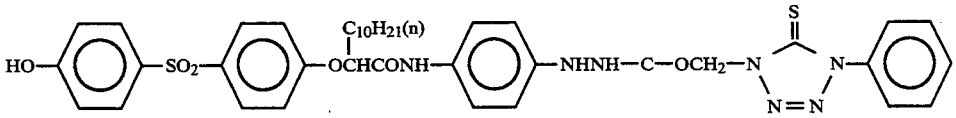

1.

-continued
2.
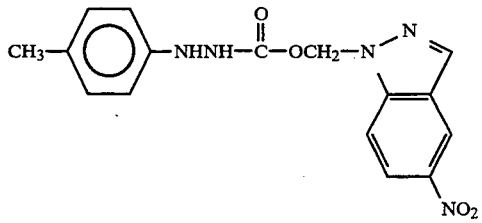
3.
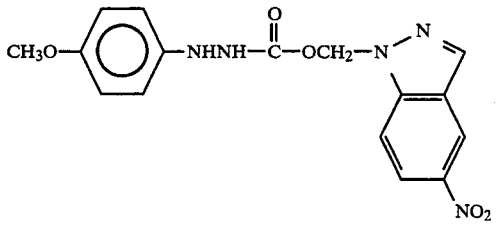
4.
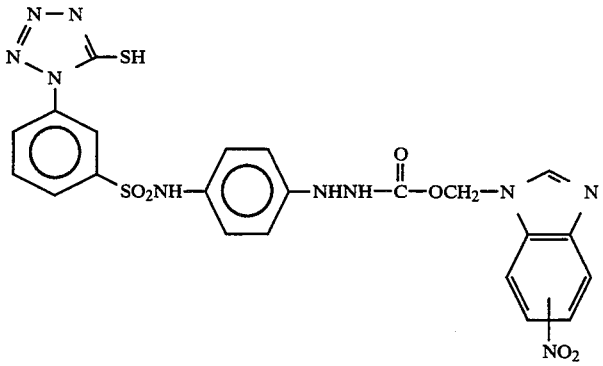
5.
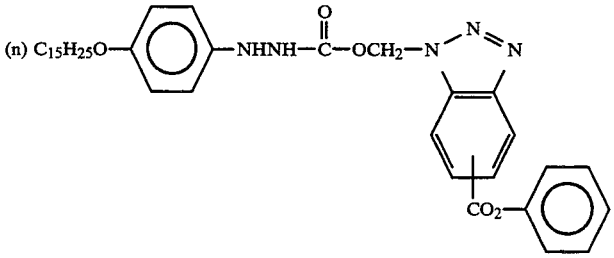
6.
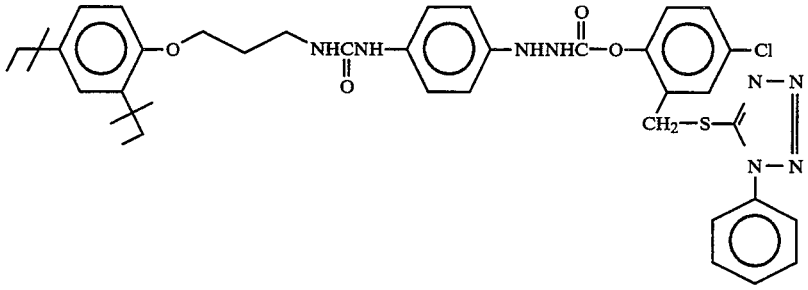
7.
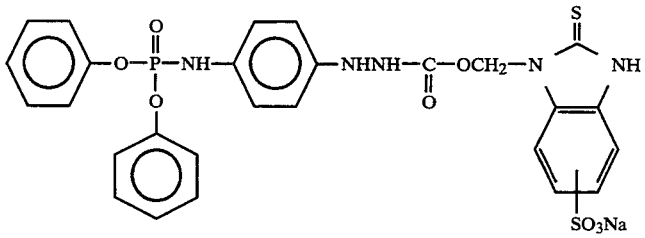

-continued
8.
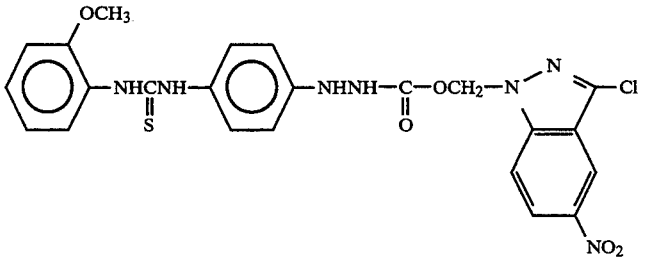
9.
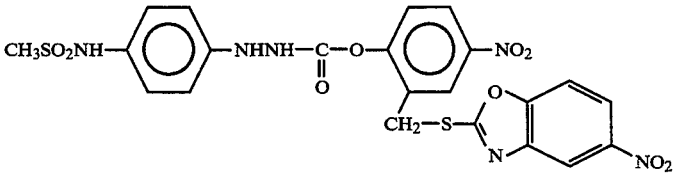
10.
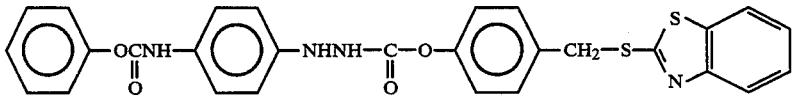
11.
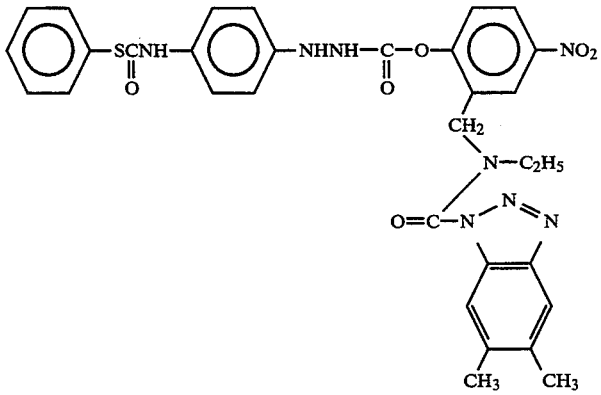
12.
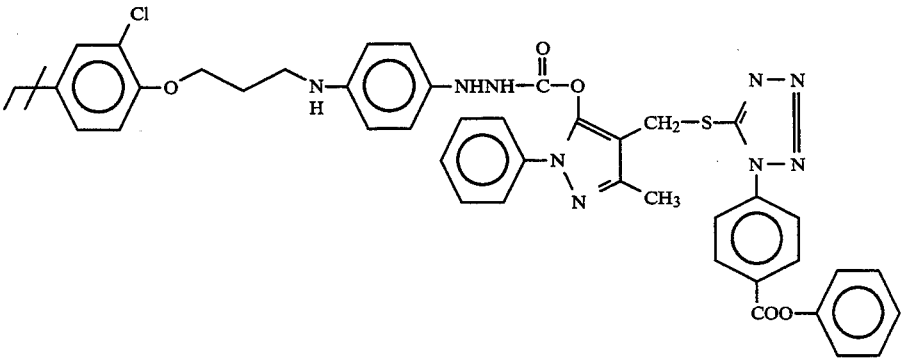
13.
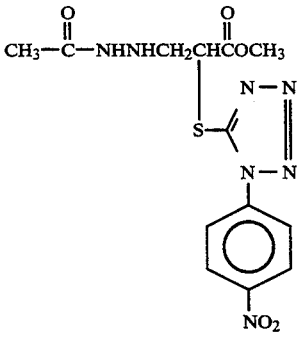

-continued
14.
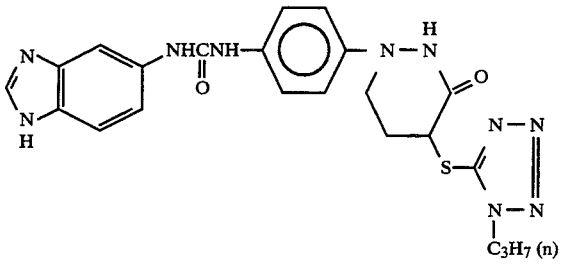
15.
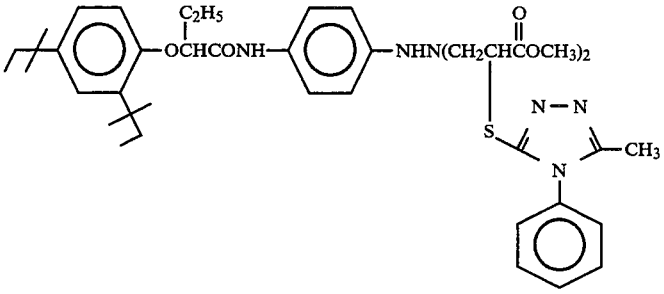
16.
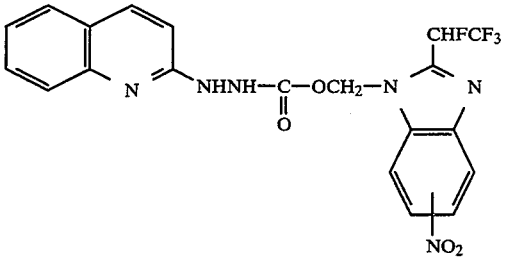
17.
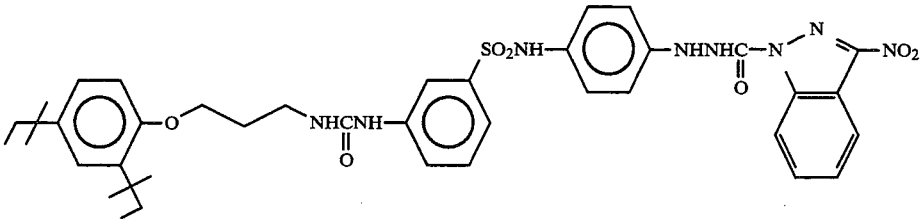
18.
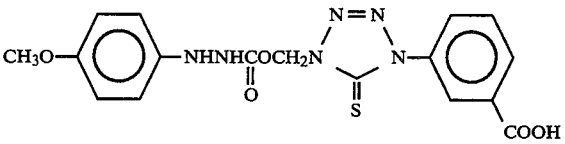
19.
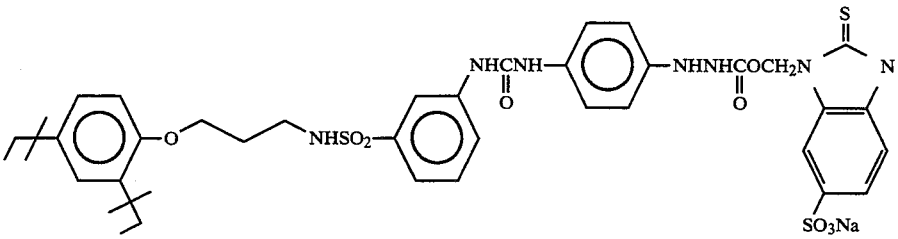
20.
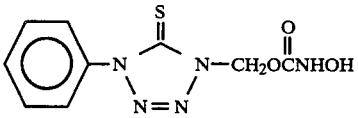

-continued
21.
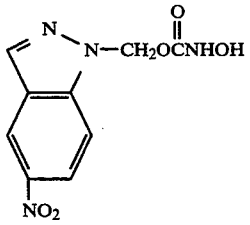
22.
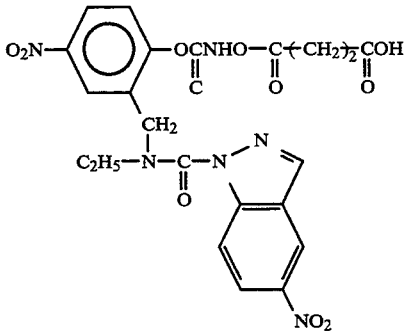
23.
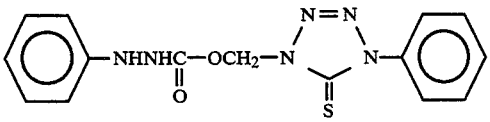
24.
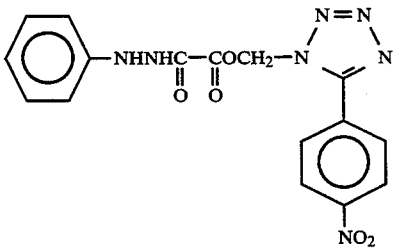
25.
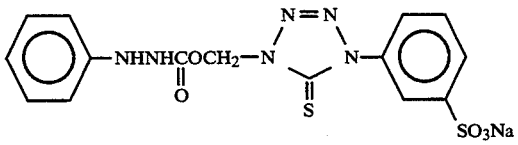
26.
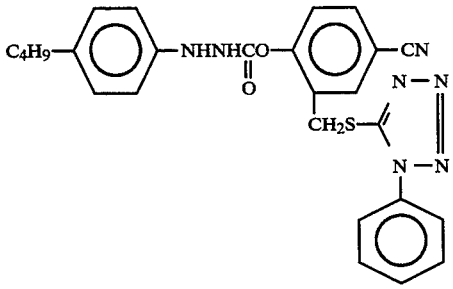
27.
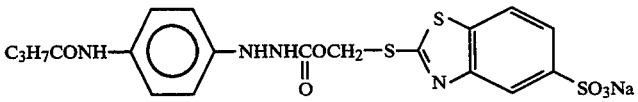

-continued
28.
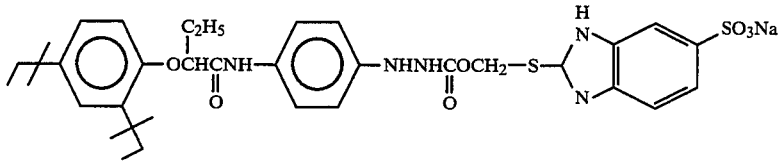
29.
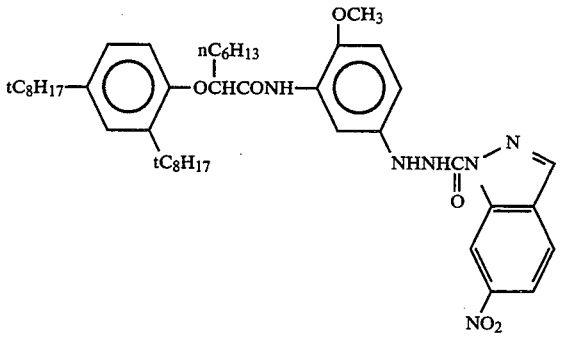
30.
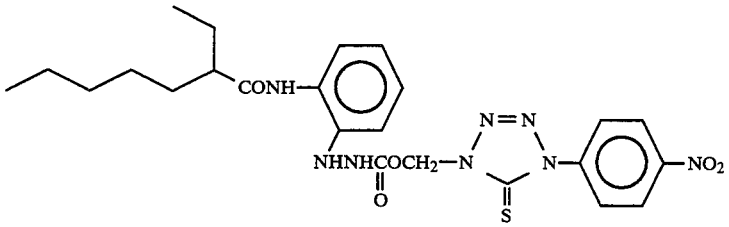
31.
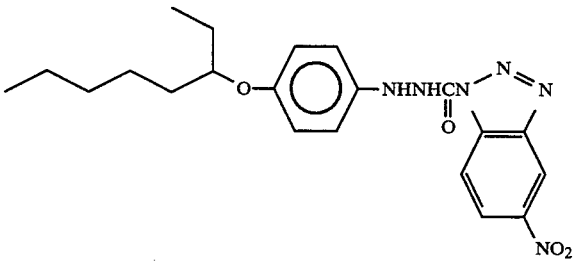
32.
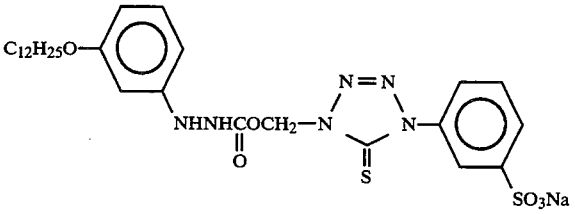
33.
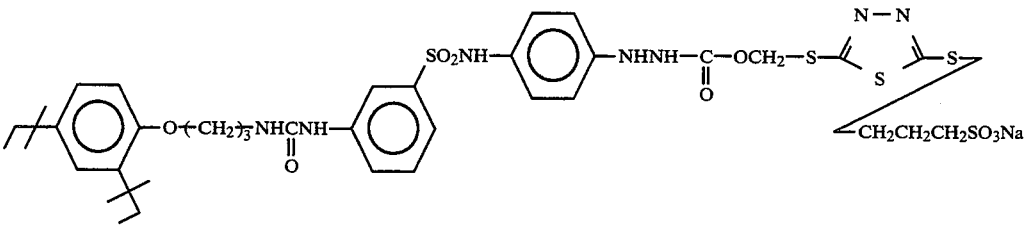

-continued
34.
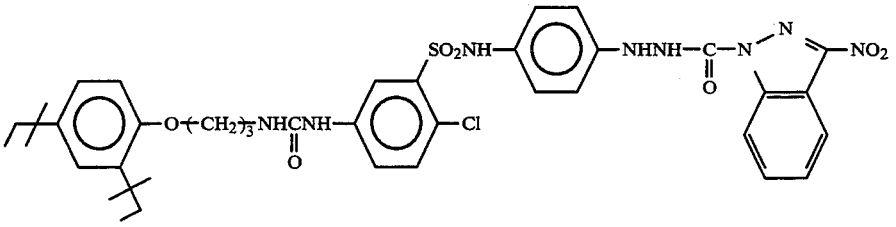
35.
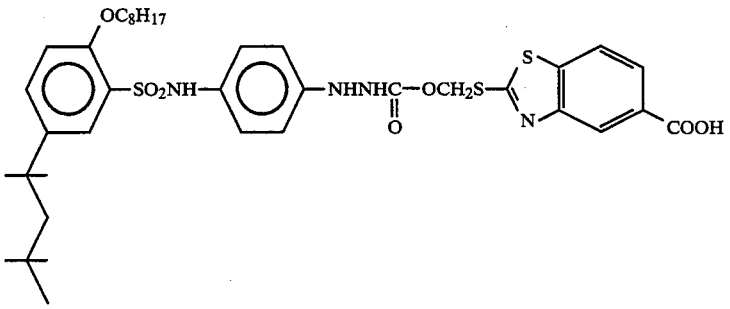
36.
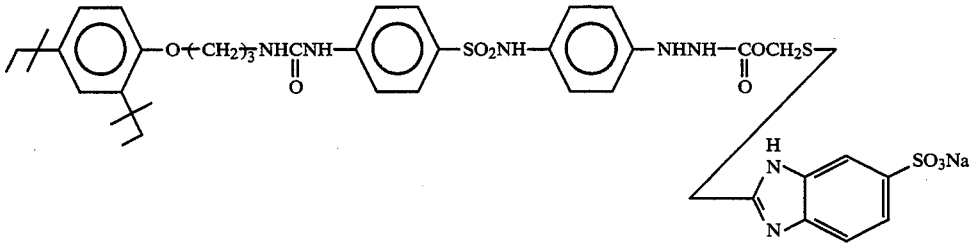
37.
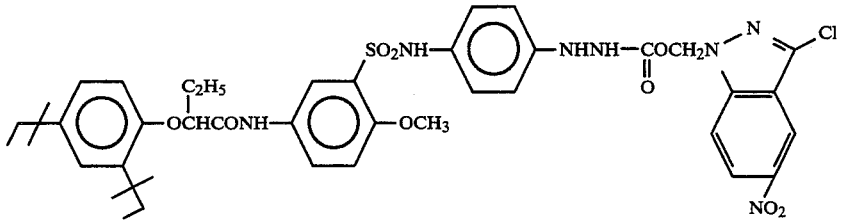
38.
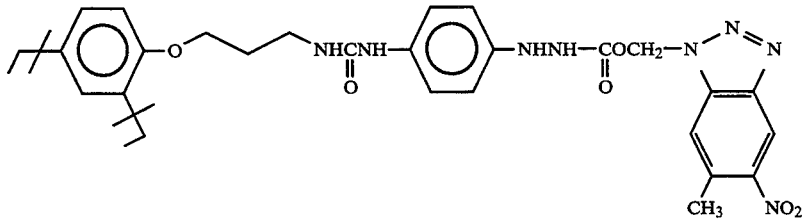
39.
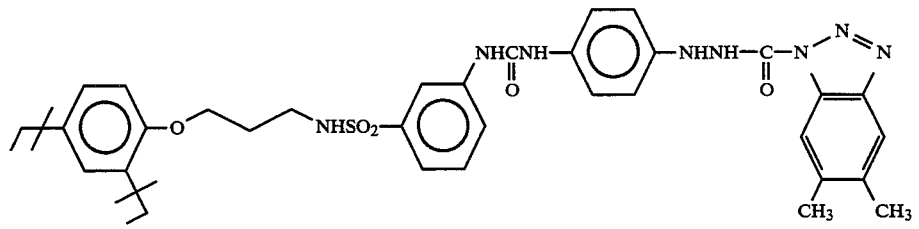

-continued
40.
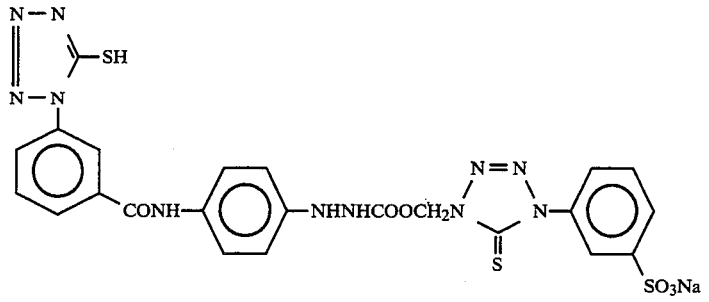
41.
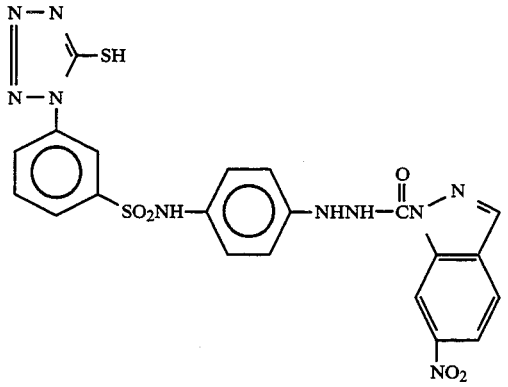
42.
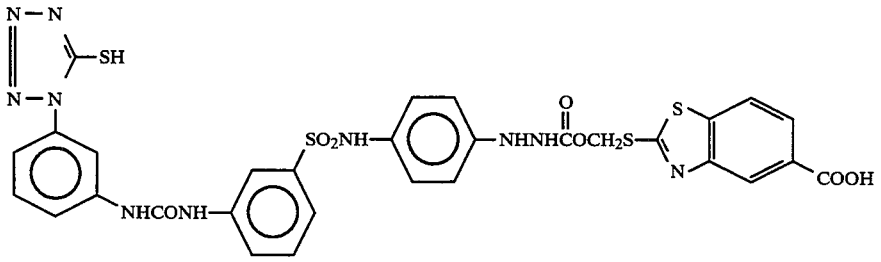
43.
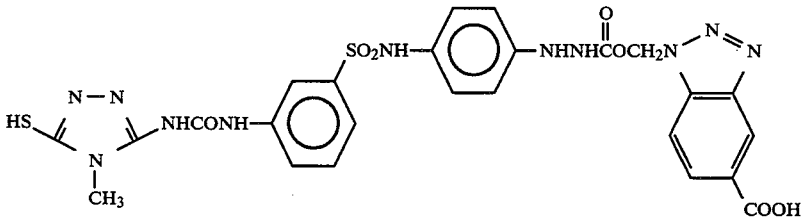
44.
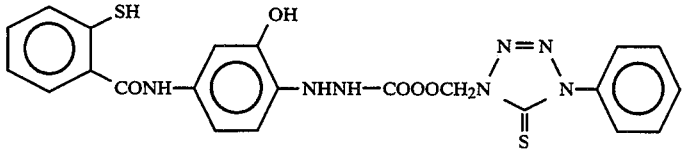

-continued
45.
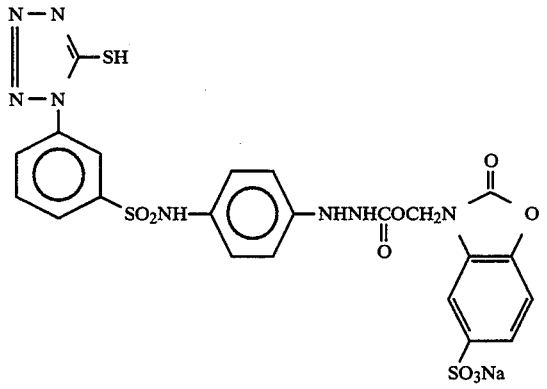
46.
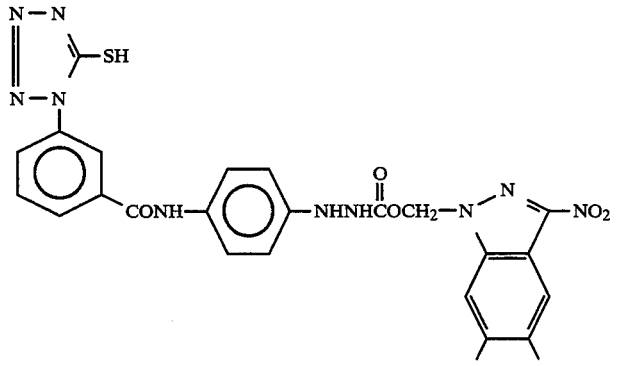
47.
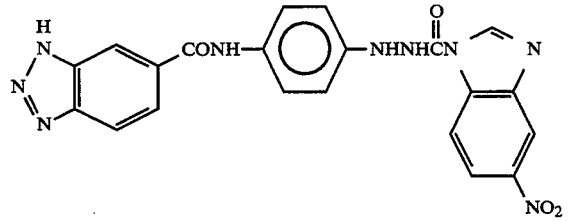
48.
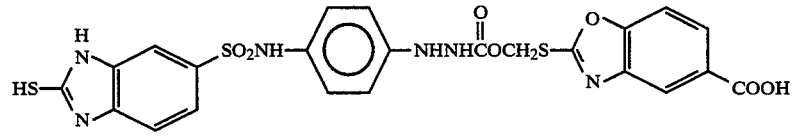
49.
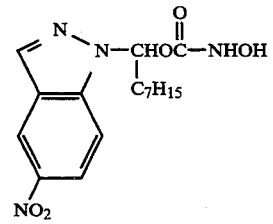
50.
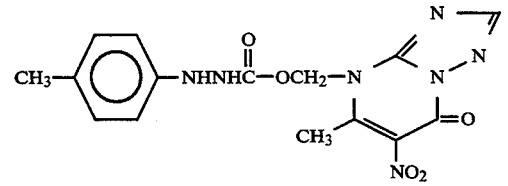

-continued
51
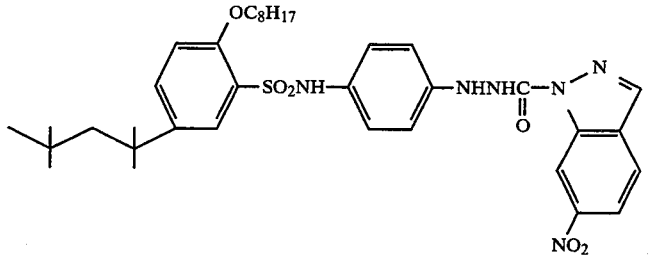
52
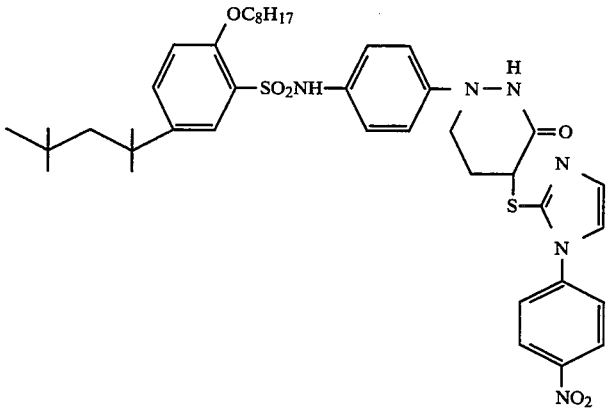
53
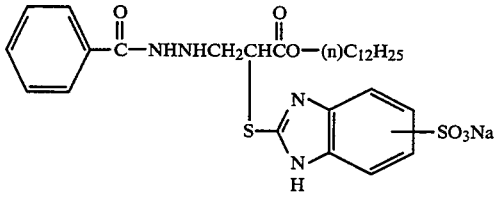
54
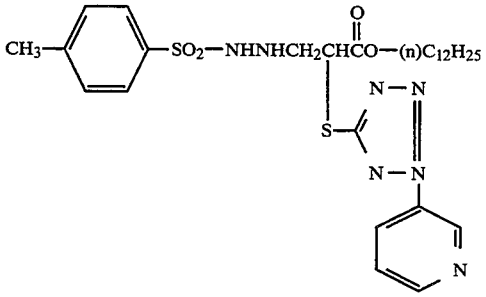
55
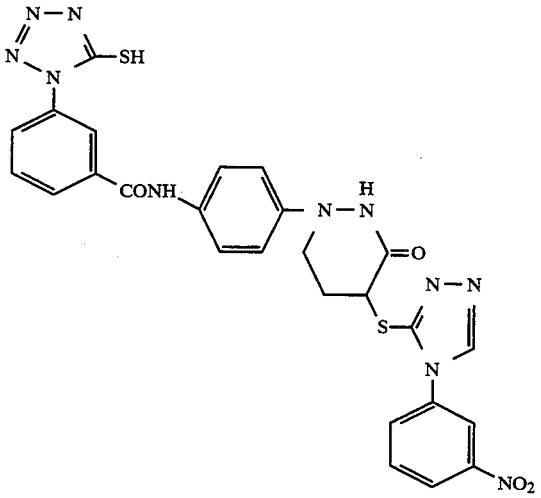

-continued
56
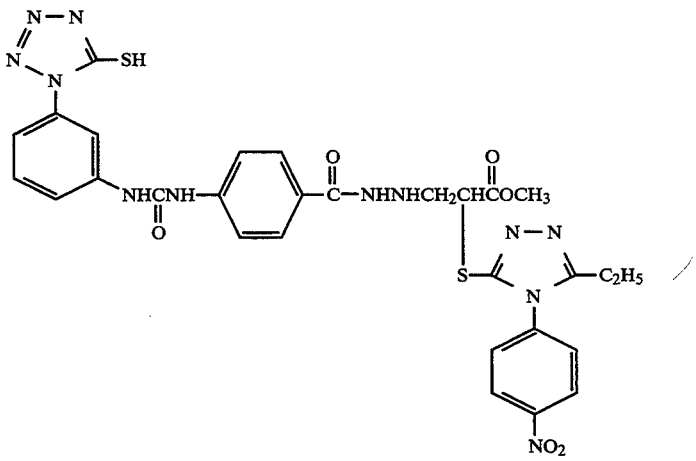
57
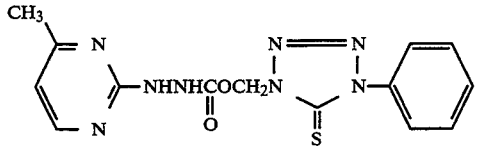
58
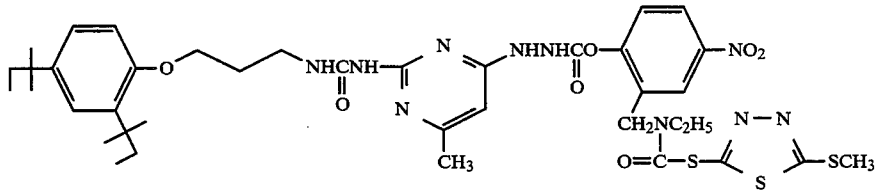
59
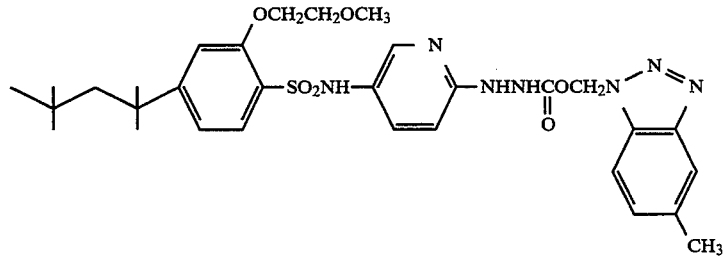
60
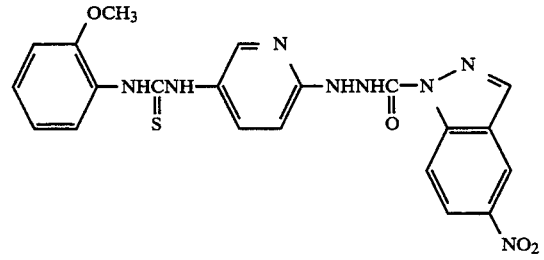
61
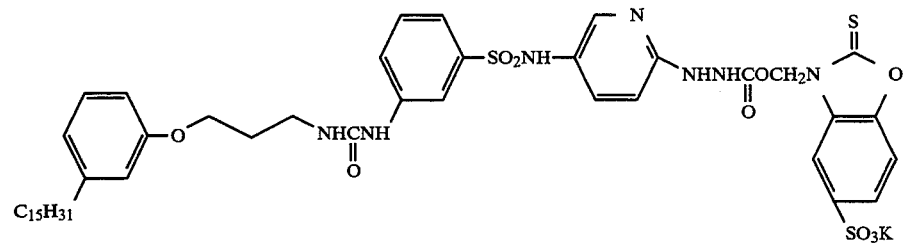

-continued

62

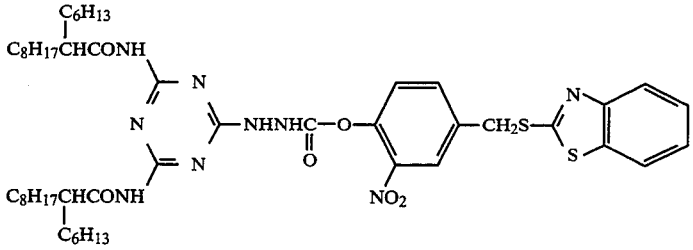

63

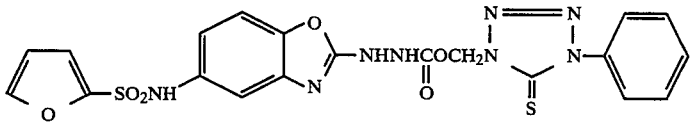

64

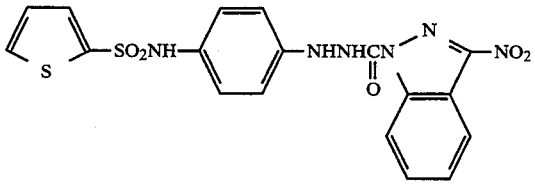

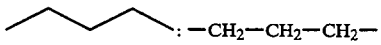

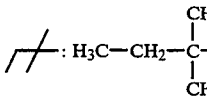

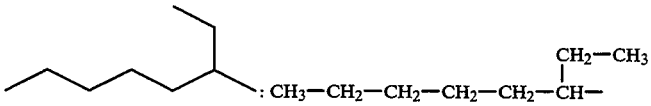

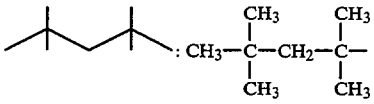

The redox compounds of the present invention are used in amounts within the range from $1.0\times10^{-7}$ to $1.0\times10^{-3}$ mol/m$^2$ of the layer, and preferably in amounts within the range from $1.0\times10^{-6}$ to $1.0\times10^{-4}$ mol/m$^2$ of the layer.

The redox compounds of the present invention can be used after dissolution in a suitable water miscible organic solvent such as an alcohol (methanol, ethanol, propanol, fluorinated alcohol), a ketone (acetone, methyl ethyl ketone), dimethylformamide, dimethylsulfoxide or methylcellosolve, for example.

Furthermore, the redox compounds can be dissolved using auxiliary solvents such as ethyl acetate or cyclohexanone in oils (such as dibutyl phthalate, tricresyl phosphate, glyceryl triacetate or diethyl phthalate) and then formed for use into emulsified dispersions mechanically in accordance with well known methods of emulsification and dispersion. Alternatively, the redox compounds can be prepared by dispersing the powdered redox compound in water using a ball mill or a colloid mill, or using ultrasonics, in accordance with known methods for the dispersion for solids.

The layers which contain the redox compounds of the present invention may be positioned above or below the light-sensitive emulsion layers which contain the hydrazine derivatives. It is preferred that the layer which contains the redox compound of the present invention is positioned over the hydrazine derivative-containing layer to the support. The dot quality can further be improved by this preferred embodiment.

The layer which contains the redox compound of the present invention may contain light-sensitive or light-insensitive silver halide emulsion grains.

The layer which contains the redox compound of the present invention comprises gelatin or synthetic polymer (for example, poly(vinyl acetate), poly(vinyl alcohol)) as matrix. Further, the redox compound-containing layer of the present invention may contain known photographic additives such as a polymer latex (for example, polyethyl acrylate, polybutyl acrylate), a matting agent (for example, polymethyl methacrylate particles, $SiO_2$ particles), a dye (water-soluble or solid form), a hardening agent and a surface active agent. The redox compound-containing layer may further contain a reducing agent such as ascorbic acid, hydroquinones, and pyrazolidones. The content of the redox compound in the layer is 0.1 to 100%, preferably 0.5 to 50% by weight based on the matrix content.

An intermediate layer which contains gelatin or synthetic polymer (for example, poly(vinyl acetate), poly(- vinyl alcohol)) may be positioned between the layer which contains the redox compound of the present invention and the light-sensitive emulsion layer which contains the hydrazine derivative.

The hydrazine derivatives contained in the at least one light-sensitive silver halide emulsion layer of the present invention are preferably compounds which can be represented by the general formula (II) indicated below:

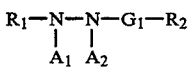

(II)

In this formula, $R_1$ represents an aliphatic group or an aromatic group, $R_2$ represents a hydrogen atom, an alkyl group, an aryl group, an alkoxy group, an aryloxy group, an amino group, a carbonyl group or an oxycarbonyl group, $G_1$ represents a carbamoyl group, a sulfonyl group, a sulfoxy group, a

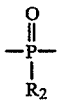

group (wherein $R_2$ is defined as above) or an iminomethylene group, and $A_1$ and $A_2$ represent hydrogen atoms, or one of them represents a hydrogen atom and the other represents a substituted or unsubstituted alkylsulfonyl group, a substituted or unsubstituted arylsulfonyl group or a substituted or unsubstituted acyl group.

The aliphatic groups represented by $R_1$ in general formula (II) preferably have 1 to 30 carbon atoms. They are most preferably linear chain, branched or cyclic alkyl groups which have 1 to 20 carbon atoms. The branched alkyl groups may be cyclized in such a way that a saturated heterocyclic ring containing one or more hetero atoms is formed. Furthermore, the aliphatic groups may have substituent groups, for example aryl, alkoxy, sulfoxy, sulfonamido or carboxamido groups.

The aromatic groups represented by $R_1$ in general formula (II) are single ring or double ring aryl groups or unsaturated heterocyclic groups. The unsaturated heterocyclic groups may be condensed with single ring or double ring aryl groups to form heteroaryl groups.

For example, the aromatic group represented by $R_1$ may be a benzene ring, a naphthalene ring, a pyridine ring, a pyrimidine ring, an imidazole ring, a pyrazole ring, a quinoline ring, an isoquinoline ring, a benzimidazole ring, a thiazole ring or a benzothiazole ring. Of these, those which contain a benzene ring are preferred.

Aryl groups are especially preferred for $R_1$.

The aryl groups or unsaturated heterocyclic groups represented by R1 may be substituted. Typical substituent groups include, for example, alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, alkyloxycarbonyl groups, aryloxycarbonyl groups, acyl groups, acyloxy groups, carboxamido groups, sulfonamido groups, carboxyl groups, phosphoric acid amido groups, diacylamino groups and imido groups. The preferred substituent groups are, for example, linear chain, branched or cyclic alkyl groups (which preferably have 1 to 20 carbon atoms), aralkyl groups (preferably single ring or double ring groups of which the alkyl part has 1 to 3 carbon atoms), alkoxy groups (which preferably have 1 to 20 carbon atoms), substituted amino groups (preferably amino groups substituted with alkyl groups which have 1 to 20 carbon atoms), acylamino groups (which preferably have 2 to 30 carbon atoms), sulfonamido groups (which preferably have 1 to 30 carbon atoms), ureido groups (which preferably have 1 to 30 carbon atoms) and phosphoric acid amido groups (which preferably have 1 to 30 carbon atoms).

The alkyl groups represented by $R_2$ in general formula (II) are preferably alkyl groups which have 1 to 4 carbon atoms. These alkyl groups may be substituted, for example, with halogen atoms, cyano groups, carboxyl groups sulfo groups, alkoxy groups, phenyl groups and sulfonyl groups.

The aryl groups represented by $R_2$ in general formula (II) are preferably single ring or double ring aryl groups, for example groups which contain a benzene ring. These aryl groups may be substituted, for example, with halogen atoms, alkyl groups, cyano groups, carboxyl groups, sulfo groups and sulfonyl groups.

The alkoxy groups preferably have 1 to 8 carbon atoms, and they may be substituted, for example, with halogen atoms and aryl groups.

The aryloxy groups preferably have a single ring which may have halogen atoms, for example, as substituent groups.

The amino groups are preferably unsubstituted amino groups, or alkylamino groups or arylamino groups which have 1 to 10 carbon atoms. They may be substituted, for example, with alkyl groups, halogen atoms, cyano groups, nitro groups and carboxyl groups.

The carbamoyl groups are preferably unsaturated carbamoyl groups, or alkyl carbamoyl groups or arylcarbamoyl groups which have 1 to 10 carbon atoms. They may be substituted, for example, with alkyl groups, halogen atoms, cyano groups and carboxyl groups.

The oxycarbonyl groups are preferably alkoxycarbonyl groups or aryloxycarbonyl groups which have 1 to 10 carbon atoms. They may be substituted, for example, with alkyl groups, halogen atoms, cyano groups and nitro groups.

In those case where $G_1$ is a carbonyl group, the preferred groups among those which can be represented by $R_2$ are, for example, a hydrogen atom, alkyl groups (for example, methyl, trifluoromethyl, 3-hydroxypropyl, 3-methanesulfonamidopropyl, phenylsulfonylmethyl), aralkyl groups (for example, o-hydroxybenzyl) and aryl groups (for example, phenyl, 3,5-dichlorophenyl, o-methanesulfonamidophenyl, 4-methanesulfonylphenyl). A hydrogen atom is especially desirable.

Furthermore, in those cases where $G_1$ is a sulfonyl group, $R_2$ is preferably an alkyl group (for example, methyl), an aralkyl group (for example, o-hydroxyphenylmethyl), an aryl group (for example, phenyl), or a substituted amino group (for example, dimethylamino).

In those cases where $G_1$ is a sulfoxy group, $R_2$ is preferably a cyanobenzyl group or a methylthiobenzyl group.

In those cases where $G_1$ is a

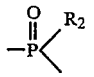

group, $R_2$ is preferably a methoxy, ethoxy, butoxy, phenoxy or phenyl group, and most preferably a phenoxy group.

In those cases where $G_1$ represents an N-substituted or unsubstituted iminomethylene group, $R_2$ is preferably a methyl, ethyl, or a substituted or unsubstituted phenyl group.

The substituent groups listed in connection with $R_1$ are appropriate as substituent groups for $R_2$.

$G_1$ in general formula (II) is most desirably a carbonyl group.

Furthermore, $R_2$ may be a group such that a cyclization reaction occurs, cleaving the $G_1$—$R_2$ moiety from the rest of the molecule and forming a ring structure which contains the atoms of the —$G_1$—$R_2$ moiety. The clearing agent may be represented by the general formula (a):

$$-R_3-Z_1 \qquad \text{(a)}$$

In this formula, $Z_1$ is a group which makes a nucleophilic attack on $G_1$ and cleaves the $G_1$—$R_2$—$Z_1$ moiety from the rest of the molecule, and $R_3$ is a group derived by removing one hydrogen atom from $R_2$, and $Z_1$ can make a nucleophilic attack on $G_1$ and form a ring structure with $G_1$, $R_3$ and $Z_1$.

More precisely, $Z_1$ is a group which, when the reaction intermediate $R_1$—N=N—$G_1$—$R_3$—$Z_1$ has been formed by the oxidation of the hydrazine compound of general formula (II), readily undergoes a nucleophilic reaction with $G_1$ and causes the $R_1$—N=N group to be cleaved from $G_1$. $Z_1$ may be a functional group which directly reacts with $G_1$, such as OH, SH, $NHR_4$ or —COOH (where $R_4$ is a hydrogen atom, an alkyl group, an aryl group, —$COR_5$ or —$SO_2R_5$, in which $R_5$ represents a hydrogen atom, an alkyl group, an aryl group or a heterocyclic group for example). The OH, SH, $NHR_4$, and —COOH groups may be protected so that these groups are formed by hydrolysis with an alkali for example).

$Z_1$ may also be a functional group such as

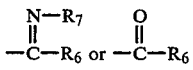

(where $R_6$ and $R_7$ represent hydrogen atoms, alkyl groups, alkenyl groups, aryl groups or heterocyclic groups), which can react with $G_1$ as a result of a reaction of a nucleophilic agent such as a hydroxide ion or a sulfite ion.

Furthermore, the ring formed by $G_1$, $R_3$ and $Z_1$ is preferably a five or six membered ring.

Preferred groups within the scope of general formula (a) can be represented by the following general formulae (b) and (c).

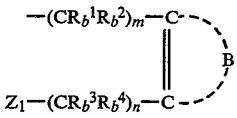

(b)

In this formula, $R_b^1$–$R_b^4$, which may be the same or different, each represents a hydrogen atom, an alkyl group (which preferably has 1 to 12 carbon atoms), an alkenyl group (which preferably has 2 to 12 carbon atoms) or an aryl group (which preferably has 6 to 12 carbon atoms). B represents the atoms which are required to form a five or six membered ring which may have substituent groups, m and n represent 0 or 1, and (m+n) has a value of 1 or 2.

Examples of five or six membered rings formed by B include a cyclohexene ring, a cycloheptene ring, a benzene ring, a naphthalene ring, a pyridine ring and a quinoline ring.

$Z_1$ has the same meaning as in general formula (a).

General Formula (c) is shown below:

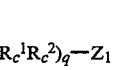

(c)

In this formula, $R_c^1$ and $R_c^2$ each represents a hydrogen atom, an alkyl group, an alkenyl group, an aryl group or a halogen atom, which may be the same or different.

$R_c^3$ represents a hydrogen atom, an alkyl group, an alkenyl group or an aryl group.

Moreover, p represents 0, 1 or 2, and q represents an integer of from 1 to 4.

$R_c^1$, $R_c^2$ and $R_c^3$ may be joined together to form a ring provided that the structure allows for an intramolecular nucleophilic attack by $Z_1$ on $G_1$.

$R_c^1$ and $R_c^2$ are preferably hydrogen atoms, halogen atoms or alkyl groups, and $R_c^3$ is preferably an alkyl group or an aryl group.

Moreover, q preferably has an integer of from 1 to 3, and when q is 1, p is 1 or 2, when q is 2, p is 0 or 1, and when q is 3, p is 0 or 1. When q is 2 or 3 the $CR_c^1R_c^2$ groups may be the same or different.

$Z_1$ has the same meaning as in general formula (a).

$A_1$ and $A_2$ in general formula (II) represent hydrogen atoms, alkylsulfonyl or arylsulfonyl groups which do not have more than 20 carbon atoms (preferably phenylsulfonyl groups or substituted phenylsulfonyl group in which the sum of the Hammett's substituent constants is at least −0.5) or acyl groups which do not have more than 20 carbon atoms (for example, a benzoyl, a substituted benzoyl in which the sum of the Hammett's substituent constants is at least −0.5, or a linear chain, branched or cyclic unsubstituted or substituted aliphatic acyl group (which has halogen atoms, ether groups, sulfonamido groups, carboxamido groups, hydroxyl groups, carboxyl groups or sulfonic acid groups as substituent groups)).

$A_1$ and $A_2$ are most desirably hydrogen atoms.

$R_1$ or $R_2$ in general formula (II) may incorporate within themselves ballast groups as normally used in immobile photographically useful additives such as couplers. Ballast groups are comparatively inert groups in the photographic sense which have at least eight carbon atoms, and they can be selected, for example, from among the alkyl groups, alkoxy groups, phenyl groups, alkylphenyl groups, phenoxy groups and alkylphenoxy groups.

$R_1$ or $R_2$ in general formula (II) may contain groups which increase their adsorption on silver halide grains. Examples of such adsorbing groups include groups such as the thiourea groups, heterocyclic groups, thioamido groups, mercapto heterocyclic groups and triazole groups disclosed, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244 and JP-A-63-234246.
Specific examples of the compounds represented by general formula (II) are indicated below, but the invention is not limited by these compounds.
(II-1)
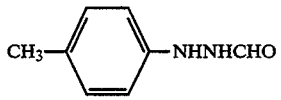
(II-2)
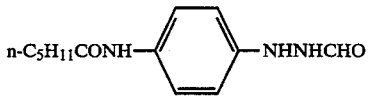
(II-3)
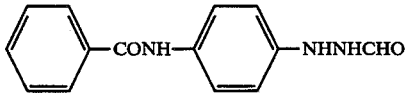
(II-4)
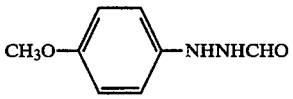
(II-5)
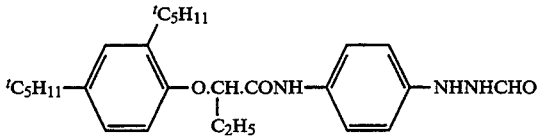
(II-6)
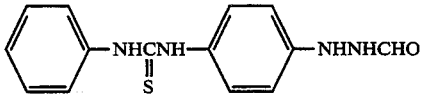
(II-7)
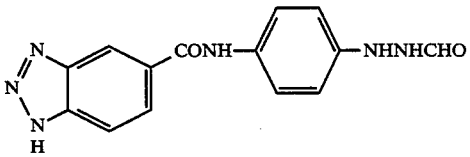
(II-8)
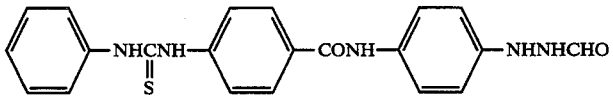
(II-9)
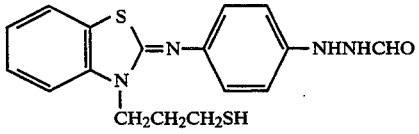
(II-10)
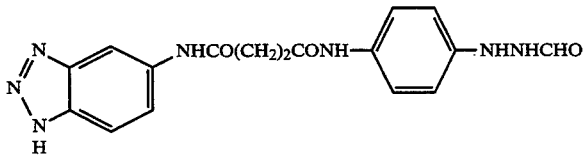
(II-11)
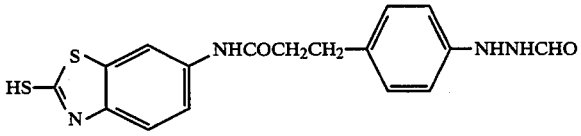

-continued
(II-12)
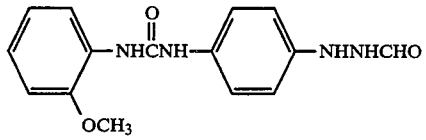
(II-13)
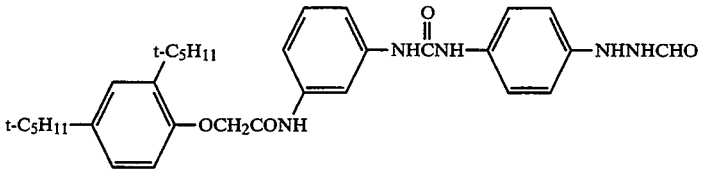
(II-14)
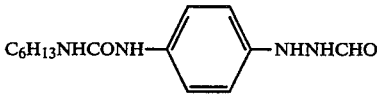
(II-15)
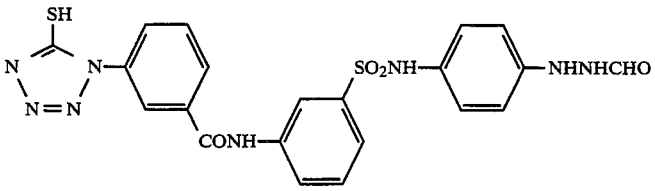
(II-16)
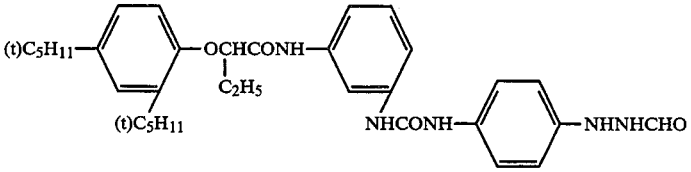
(II-17)
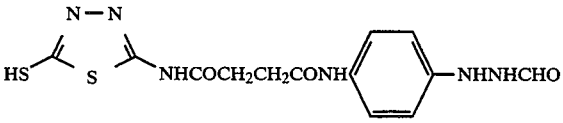
(II-18)
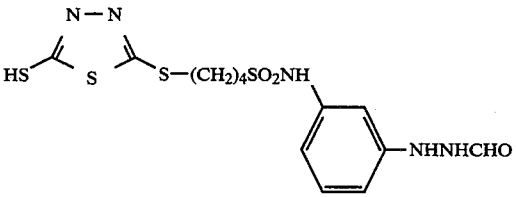
(II-19)
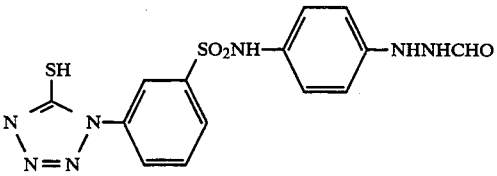
(II-20)
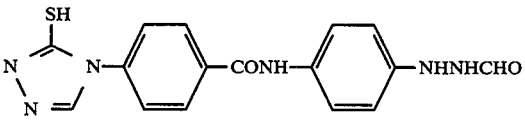

-continued
(II-21)
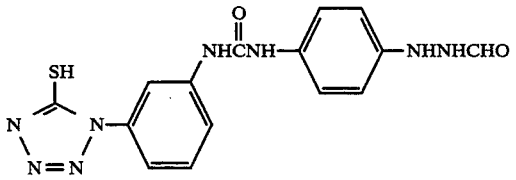
(II-22)
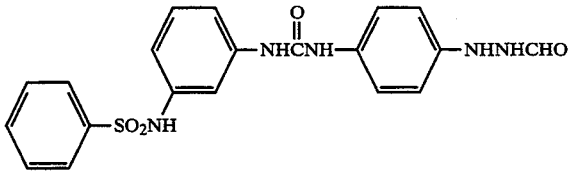
(II-23)
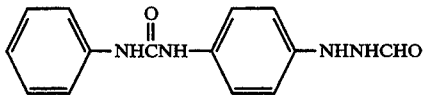
(II-24)
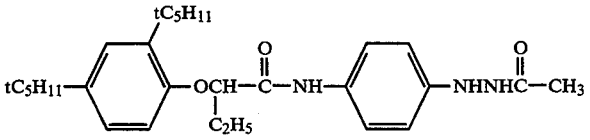
(II-25)
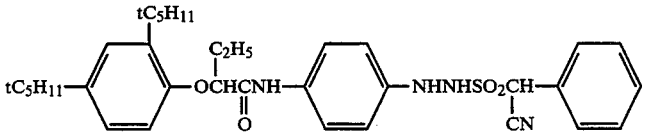
(II-26)
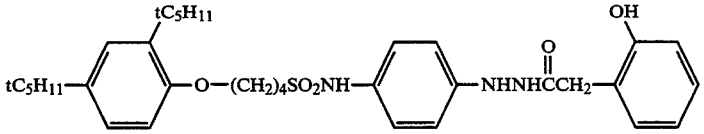
(II-27)
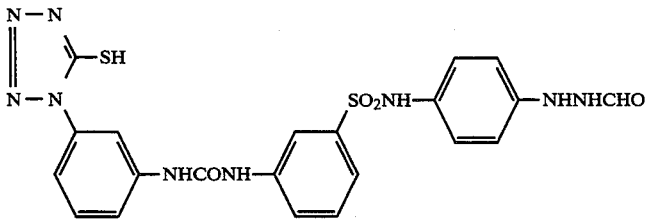
(II-28)
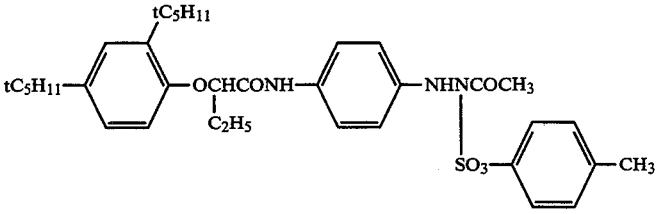
(II-29)
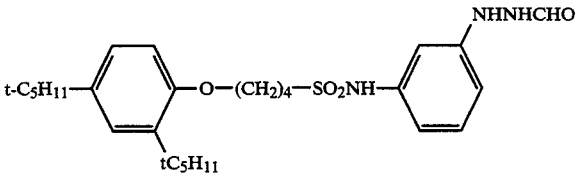

-continued
(II-30)
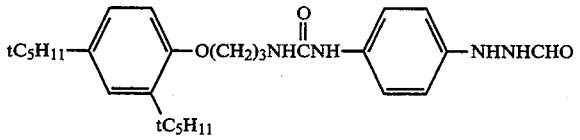
(II-31)
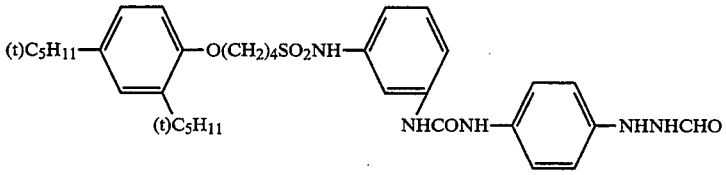
(II-32)
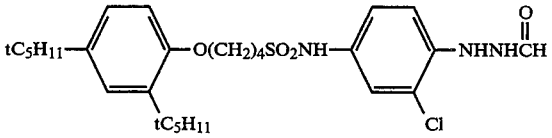
(II-33)
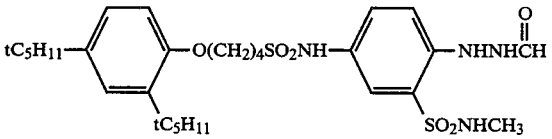
(II-34)
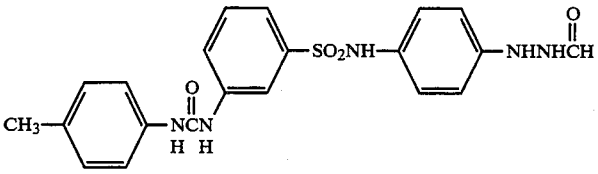
(II-35)
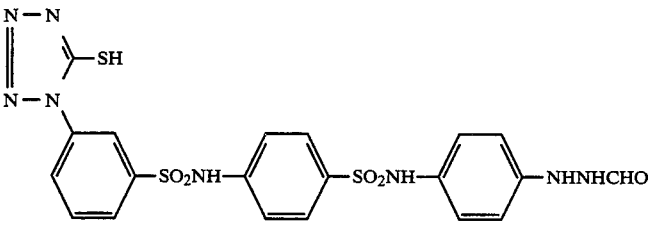
(II-36)
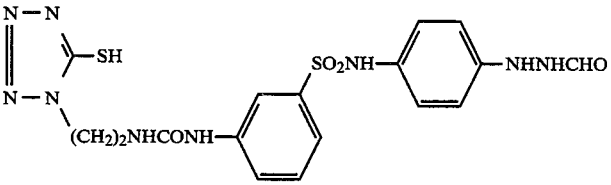
(II-37)
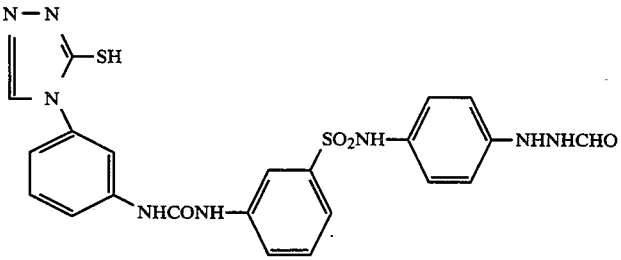

-continued
(II-38)
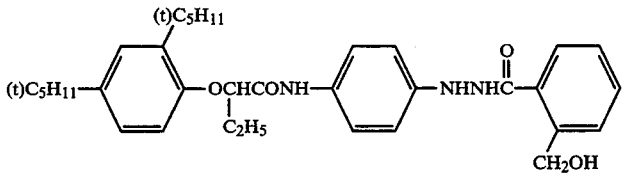
(II-39)
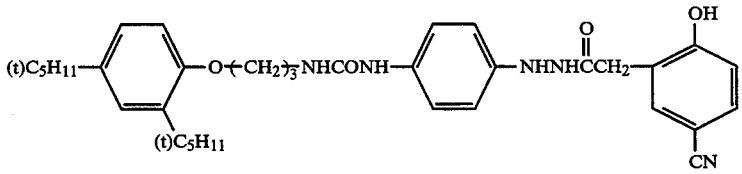
(II-40)
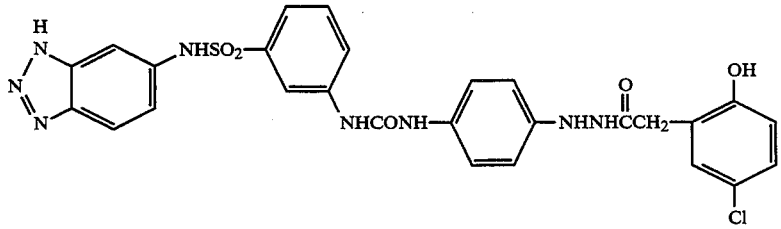
(II-41)
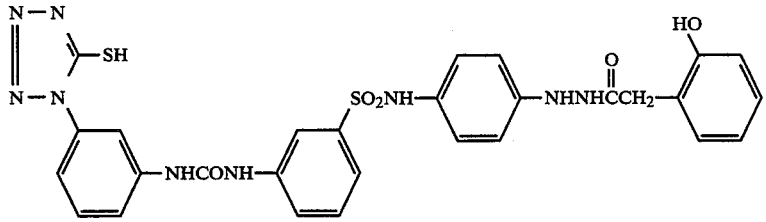
(II-42)
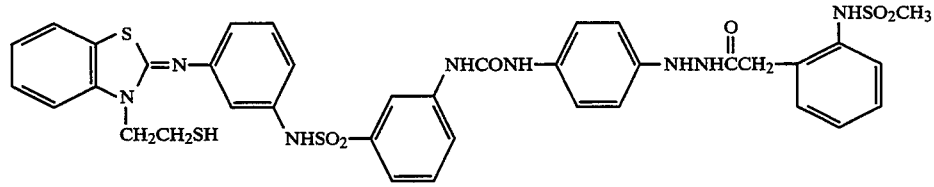
(II-43)
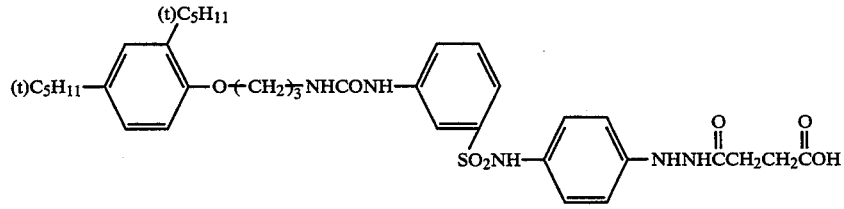
(II-44)
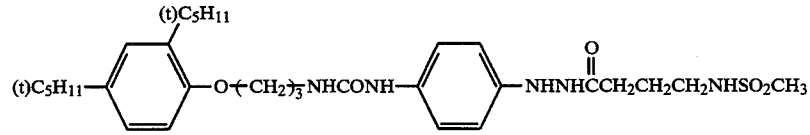
(II-45)
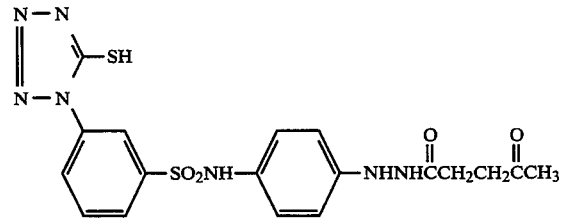

-continued
(II-46)
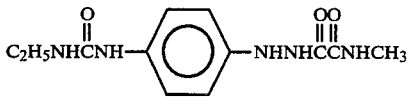
(II-47)
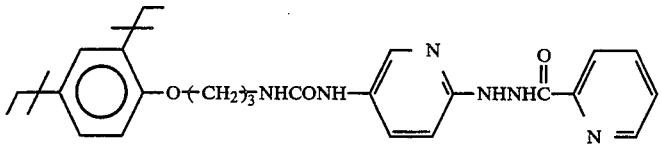
(II-48)
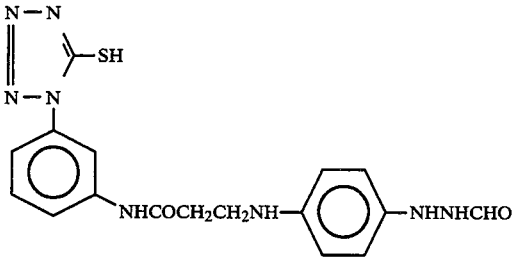
(II-49)
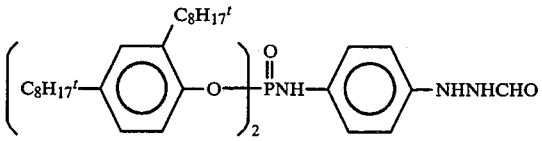
(II-50)
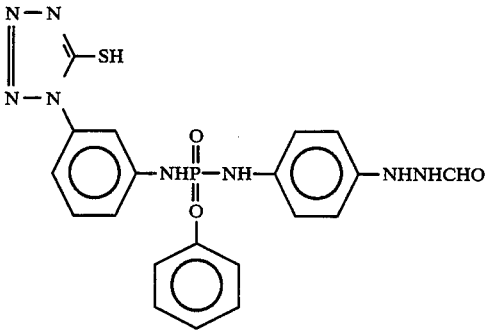
(II-51)
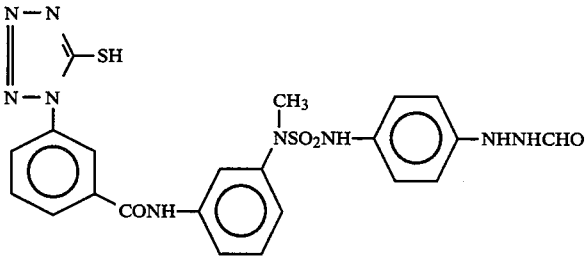
(II-52)
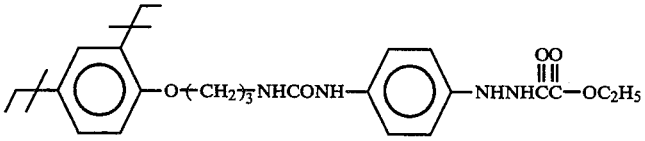
(II-53)
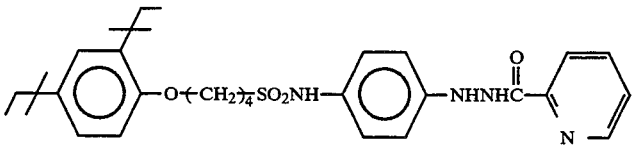

-continued (II-54)

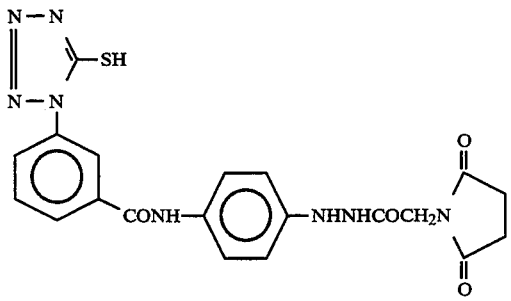

The hydrazine derivatives which can be used in the present invention include, as well as those indicated above, those disclosed in *Research Disclosure*, Item 23516 (November 1983, p. 346), and in the literature cited therein, and in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, JP-A-62-32538, JP-A-63-104047, JP-A-63-121838, JP-A-63-129337, JP-A-63-223744 and JP-A-1-10233 or U.S. Pat. No. 4,686,167, JP-A-62-178246, JP-A-63-234244, JP-A-63-234245, JP-A-63-234246, JP-A-63-294552, JP-A-63-306438, JP-A-1-90439, and Japanese Patent Application Nos. 63-105682, 63-114118, 63-110051, 63-114119, 63-116239, 63-147339, 63-179760, 63-229163, 1-18377, 1-18378, 1-18379, 1-15755, 1-16814, 1-40792, 1-42615 and 1-42616.

In those cases where a hydrazine derivative is included in the photographic material of the present invention it is included in a silver halide emulsion layer, but it may be included instead in a light-insensitive hydrophilic colloid layer (for example, in a protective layer, an intermediate layer, a filter layer or anti-halation layer). In those instances in which the hydrazine is soluble in water it can be dissolved in water for addition to the hydrophilic colloid in the form of a solution. In those cases where it is only sparingly soluble in water it can be dissolved in an organic solvent which is miscible with water, such as an alcohol, an ester or a ketone for example, for addition to the hydrophilic colloid. In those cases where the addition is made to the silver halide emulsion layer, the addition can be made at any time from the commencement of chemical ripening to a point prior to coating, but addition during the period after the completion of chemical ripening and prior to coating is preferred. Addition to the liquid which is to be used for coating is most desirable.

The amount of hydrazine included in the photographic material of the present invention is preferably the optimum amount in accordance with the grain size of the silver halide emulsion, the halogen composition, the method and degree of chemical sensitization, the layer in which the hydrazine is to be included and its relationship with the silver halide emulsion layer, and the type of anti-fogging compounds which are being used. The test methods for making such a selection are well known in the industry. Normally, the use of an amount of from $10^{-6}$ mol to $1\times10^{-1}$ mol per mol of silver halide is preferred, and the use of from $10^{-5}$ to $4\times10^{-2}$ mol per mol of silver halide is most preferred.

The silver halide emulsion used in the present invention may have any composition, such as silver chloride, silver chlorobromide, silver iodobromide or silver iodochlorobromide for example.

The average grain size of the silver halide used in the present invention is preferably very fine (for example, not more than 0.7 μm), and a grain size of not more than 0.5 μm is most desirable. Fundamentally, no limitation is imposed upon the grain size distribution, but the use of a mono-dispersion is preferred. The term "mono-dispersion" signifies that the emulsion is comprised of grains such that at least 95% of the grains in terms of the number of grains or by weight are of a size within ±40% of the average grain size.

The silver halide grains in the photographic emulsion may have a regular crystalline form such as a cubic or octahedral form, or they may have an irregular form such as a spherical or plate-like form, or they may have a form which is a composite of these forms.

The silver halide grains may be such that the interior and surface layer are in a uniform phase, or the interior and surface layers may be in different phases. Use can also be made of mixtures of two or more types of silver halide emulsion which have been prepared separately.

Cadmium salts, sulfites, lead salts, thallium salts, rhodium salts or complex salts thereof, iridium salts or complex salts thereof, may also be present during the formation and physical ripening processes of the silver halide grains in the silver halide emulsions used in the present invention.

Water soluble dyes can be included in the emulsion layers or other hydrophilic colloid layers of the present invention as filter dyes, for the prevention of irradiation, or for various other purposes. Dyes for further reducing photographic speed can be used as filter dyes. Preferably, they are ultraviolet absorbers which have a spectral absorption peak in the intrinsically sensitive region of silver halides and dyes which essentially absorb light principally within the 350 nm–600 nm range for increasing stability with respect to safe-lighting when materials are being handled as bright room light-sensitive materials.

These dyes may be added to the emulsion layer or they may be added together with a mordant to a light-insensitive hydrophilic layer above the silver halide emulsion layer (which is to say to a light-insensitive layer which is further from the support than the silver halide emulsion layer) and fixed in this layer, depending on the intended purpose of the dye.

The amount added differs according to the molecular extinction coefficient of the dye, but it is normally within the range from $10^{-2}$ g/m$^2$ to 1 g/m$^2$, and preferably within the range from 50 mg/m$^2$ to 500 mg/m$^2$.

Specific examples of dyes have been disclosed in JP-A-63-64039, some of which are indicated below.

(1)

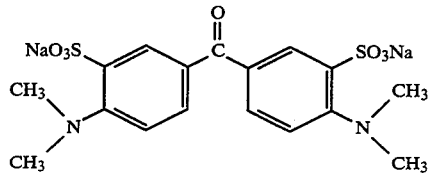

(2)

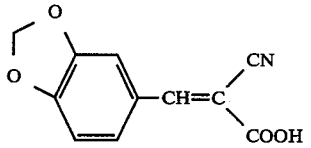

(3)

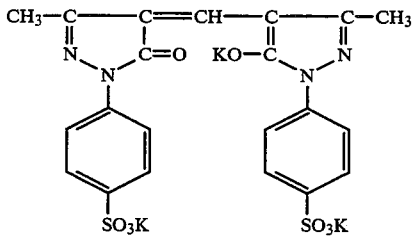

(4)

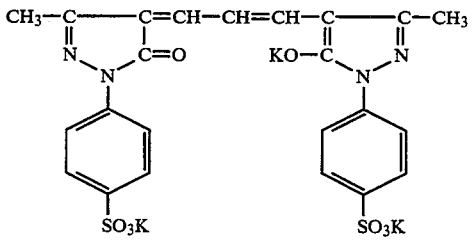

(5)

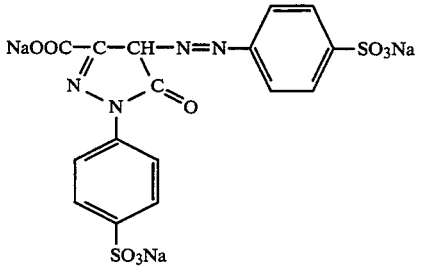

(6)

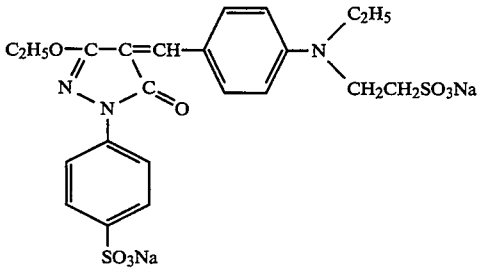

The above mentioned dyes are dissolved in a suitable solvent [for example, water, an alcohol (for example, methanol, ethanol, propanol), acetone or methylcellosolve, or in a mixture of such solvents] and added to the coating liquid which is used for the light-insensitive hydrophilic colloid layer of the present invention.

Two or more of these dyes can be used in combination.

The dyes of the invention are used in the amounts required to enable the materials to be handled in a bright room.

The amount of dye used has been found to be in general from $10^{-3}$ g/m$^2$ to 1 g/m$^2$, and preferably within the range from $10^{-3}$ g/m$^2$ to 0.5 g/m$^2$.

Gelatin is useful as a binding agent or a protective colloid for photographic emulsions, but other hydrophilic colloids also can be used for this purpose. For example, gelatin derivatives, graft polymers of other polymers with gelatin, and proteins such as albumin and casein, cellulose derivatives (such as hydroxyethylcellulose, carboxymethylcellulose and cellulose sulfate esters), sodium alginate, sugar derivatives (such as starch derivatives), and many synthetic hydrophilic polymer materials (such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole), either as homopolymers or as copolymers can be used.

Acid treated gelatin can be used as well as lime treated gelatin. Gelatin hydrolyzates and enzyme degradation products of gelatin can also be used.

The silver halide emulsions used in the present invention may or may not be subjected to chemical sensitization. Sulfur sensitization, reduction sensitization and precious metal sensitization are known as methods for the chemical sensitization of silver halide emulsions. Chemical sensitization can be carried out using these methods either individually or conjointly.

Gold sensitization, among the precious metal sensitization methods, is typical. Gold compounds, principally gold complex salts, are used in that method. Precious metals other than gold, for example platinum, palladium or iridium, can also be included. Specific examples have been disclosed, for example, in U.S. Pat. No. 2,448,060 and British Patent 618,061.

In addition to the sulfur compounds which are contained in gelatin, various sulfur compounds, for example thiosulfates, thioureas, thiazoles and rhodanines, can be used as sulfur sensitizing agents.

Stannous salts, amines, formamidinsulfinic acid and silane compounds can be used, for example, as reduction sensitizing agents.

Known spectrally sensitizing dyes may be used in the silver halide emulsion layers of the present invention.

Various compounds can be included in the light-sensitive materials of the present invention to prevent the occurrence of fogging during the manufacture, storage or photographic processing of the light-sensitive material, or to stabilize photographic performance. Thus, many compounds which are known as anti-fogging agents or stabilizers (azoles, for example benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes, for example triazaindenes, tetra-azaindenes (especially 4-hydroxy substituted (1,3,3a,7)tetra-azaindenes) and penta-azaindenes; benzenethiosulfonic acid; benzenesulfinic acid and benzenesulfonic acid amide) can be used for this purpose. Among these compounds, the benzotriazoles (for example, 5-methylbenzotriazole) and nitroindazoles (for example, 5-nitroindazole) are preferred. Furthermore, these compounds can be included in processing solutions.

Inorganic or organic film hardening agents can be included in the photographic emulsion layers or other hydrophilic colloid layers in the photographic materials of the present invention. For example, chromium salts (for example chrome alum), aldehydes (for example glutaraldehyde), N-methylol compounds (for example dimethylolurea), dioxane derivatives, active vinyl compounds (for example 1,3,5-triacryloylhexahydo-s-triazine, 1,3-vinylsulfonyl-2-propanol), active halogen compounds (for example 2,4-dichloro-6-hydroxy-s-triazine), and mucohalogen acids can be used individually or in combination for this purpose.

A variety of surfactants can be included for various purposes in the photographic emulsion layers or other hydrophilic colloid layers of the photographic materials of the present invention. The surfactants function as coating promotors or as anti-static agents to improve slip properties, to improve emulsification and dispersion to prevent sticking and to improve photographic performance (for example, accelerating development, increasing contrast or increasing speed).

For example, use can be made of non-ionic surfactants, such as saponin (steroid based), alkylene oxide derivatives (for example, polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example, alkylcarboxylates, alkylsulfonates alkylbenzenesulfonates, alkylnaphthalenesulfonates, alkylsulfate esters, alkylphosphate esters, N-acyl-N-alkyltaurines, sulfosuccinate esters, sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides, and cationic surfactants, such as alkylamine salts, aliphatic and aromatic quaternary ammonium salts, heterocyclic quaternary ammonium salts, for example pyridinium salts and imidazolium salts, and phosphonium salts and sulfonium salts which contain aliphatic or heterocyclic rings.

The polyalkylene oxides having a molecular weight of at least 600 disclosed in JP-B-58-9412 are especially desirable surfactants for use in the present invention. Furthermore, polymer latexes, such as poly(alkyl acrylate) latexes, can be included to provide dimensional stability. (The term "JP-B" as used herein means an "examined Japanese patent publication").

In addition to the compounds disclosed, for example, in JP-A-53-77616, JP-A-54-37732, JP-A-53-137133, JP-A-60-140340 and JP-A-60-14949, various compounds which contain N or S atoms are effective as development accelerators or as nucleation infectious development accelerators are suitable for use in the present invention.

Specific examples are indicated below.

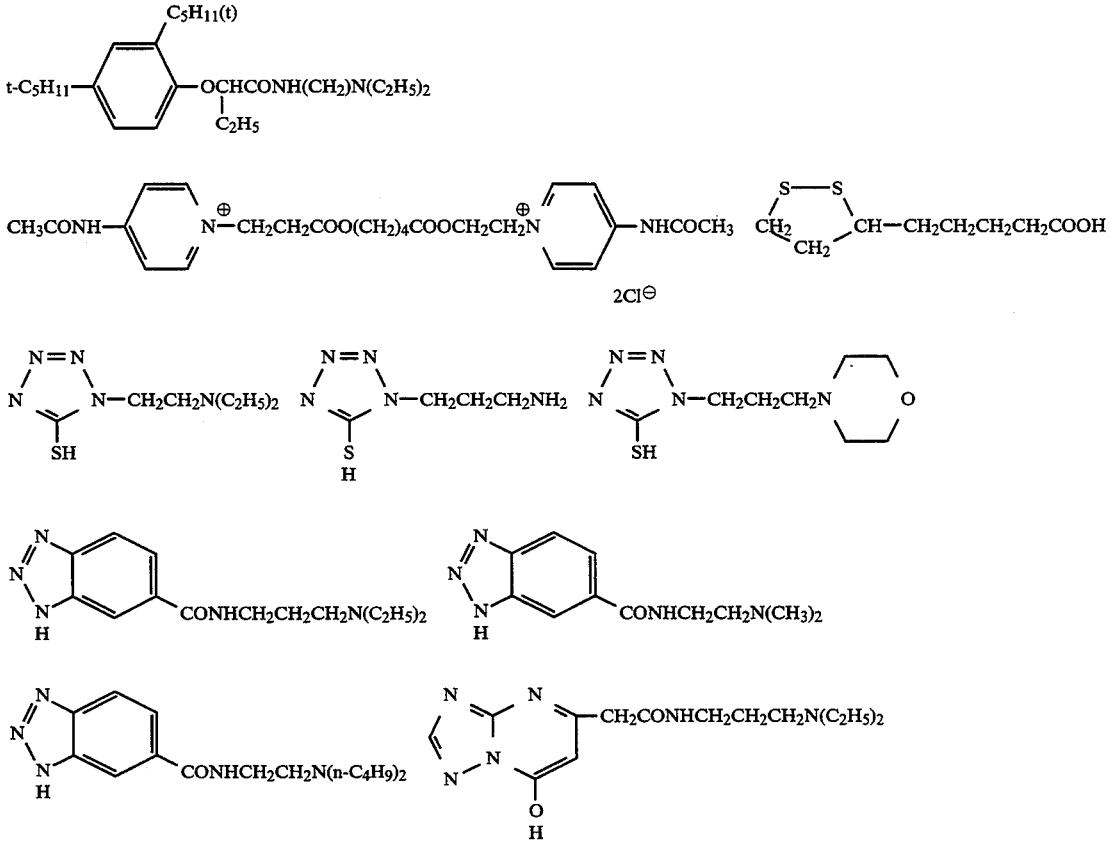

-continued

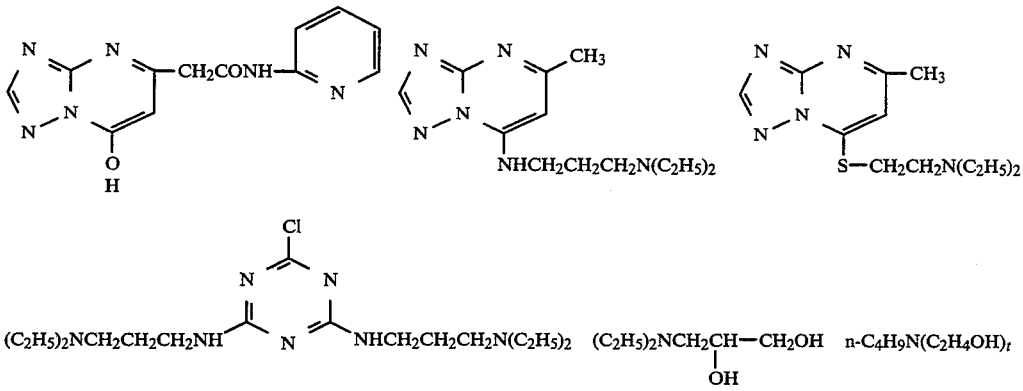

The appropriate amount of these accelerators differs according to the type of compound, but they are usually added in amounts within the range from $1.0\times10^{-3}$ to 0.5 g/m$^2$, and preferably in amounts within the range from $5.0\times10^{-3}$ to 0.1 g/m$^2$. These accelerators are dissolved in a suitable solvent (for example, water, alcohols such as methanol and ethanol, acetone, dimethylformamide or methylcellosolve) and added to the coating liquid.

A plurality of these additives can be used conjointly.

Stable developing solutions can be used to obtain superhigh contrast photographic characteristics using the silver halide photographic materials of the present invention and there is no need for the use of conventional infectious developers or the highly alkaline developers of a pH approaching 13 which are disclosed in U.S. Pat. No. 2,419,975.

In other words, superhigh contrast negative images can be obtained satisfactorily with the silver halide photographic materials of the present invention using developers of a pH 10.5–12.3, and preferably of a pH 11.0–12.0, which contain at least 0.15 mol/liter of sulfite ion as a preservative.

No particular limitation is imposed upon the developing agents which can be used in the photographic material of the present invention. Use can be made, for example, of dihydroxybenzenes (for example hydroquinone), 3-pyrazolidones (for example, 1-phenyl-3-pyrazolidone, 4,4-dimethyl-1-phenyl-3-pyrazolidone), and aminophenols (for example, N-methyl-p-aminophenol), either individually or in combination.

The silver halide photographic materials of the present invention are especially suitable for processing in developers which contain dihydroxybenzenes as the main developing agent and 3-pyrazolidones or aminophenols as auxiliary developing agents. The conjoint use of 0.05 to 0.5 mol/liter of dihydroxybenzenes and not more than 0.06 mol/liter of 3-pyrazolidones or aminophenols is preferred.

Furthermore, the development rate can be increased and the development time can be shortened by adding amines to the developer, as disclosed in U.S. Pat. No. 4,269,929.

Moreover, pH buffers, such as alkali metal sulfites, carbonates, borates and phosphates, and development inhibitors or anti-foggants, such as bromides, iodides and organic anti-foggants (nitroindazoles and benzotriazoles are especially desirable) can also be included in the developer. Hard water softening agents, dissolution promotors, toners, development accelerators, surfactants (the aforementioned polyalkylene oxides are especially desirable), anti-foaming agents, film hardening agents, and agents for preventing silver contamination of the film (for example, 2-mercaptobenzimidazolesulfonic acids) can also be included as required.

Known compositions can be used for the fixing solution. Additionally, thiosulfates and thiocyanates, the organosulfur compounds which are known to be effective can be used as fixing agents. Water soluble aluminum salts, for example, can also be included in the fixing solution as film hardening agents.

The processing temperature appropriate for the material of the present invention is normally between 18° C. and 50° C.

The use of automatic processors is preferred for photographic processing, and superhigh contrast negative gradation photographic characteristics can be obtained satisfactorily with the photographic material of the present invention even if the total processing time from the introduction of the light-sensitive material into the processor to its removal from the processor is 90 to 120 seconds.

The compounds disclosed in JP-A-56-24347 can be used in the developing solutions for the photographic material of the present invention as agents for preventing silver contamination. The compounds disclosed in JP-A-61-267759 can be used as dissolution promotors which are added to the developing solution. Moreover, the compounds disclosed in JP-A-60-93433 and the compounds disclosed in JP-A-62-186259 can be used as pH buffers in developing solutions.

The invention is described in more detail below by means of illustrative examples.

COMPARATIVE EXAMPLE 1

Preparation of the Light-sensitive Emulsion

An aqueous solution of silver nitrate and an aqueous solution of potassium iodide and potassium bromide were added simultaneously over a period of 60 minutes to an aqueous gelatin solution which was being maintained at 50° C. in the presence of $4\times10^{-7}$ mol/mol.Ag of potassium hexachloroiridium(III) while maintaining the pAg value a 7.8. A cubic mono-disperse emulsion having an average grain size 0.28 μm and an average silver iodide content 0.3 mol. % was obtained. After de-salting this emulsion using the flocculation method, 40 grams of inactive gelatin was added per mol of silver, and then 5,5'-dichloro-9-ethyl-3,3'-bis(3-sulfopropyl)oxacarbocyanine as sensitizing dye and a solution $10^{-3}$ mol per mol of silver of KI were added while maintaining the emulsion at 50° C. The temperature was dropped after ageing for 15 minutes.

Coating of the Light-sensitive Emulsion Layer

The emulsion was redissolved and the hydrazine derivative indicated below was added at 40° C.

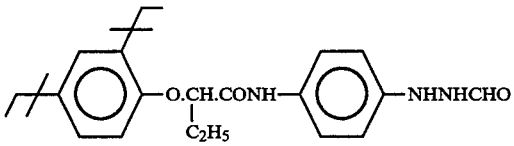

$7.1 \times 10^{-5}$ mol/mol.Ag

Moreover, 0.02 mol/mol.Ag of methylhydroquinone, 5-methylbenzotriazole, 4-hydroxy-3,3a,7-tetra-azaindene, the compounds (a) and (b) indicated below, 30 wt % with respect to the gelatin of poly(ethyl acrylate), and compound (c) indicated below as a gelatin hardening agent were added. The mixture was coated to provide a coated silver weight of 3.4 g/m$^2$ on a poly(ethylene terephthalate) film (150 μm) which had a subbing layer (0.5 μm) comprised of vinylidene chloride copolymer.

(a)

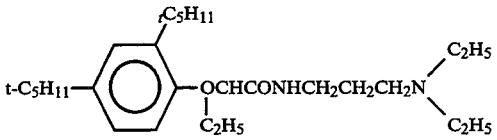

3.5 mg/m$^2$ (b)

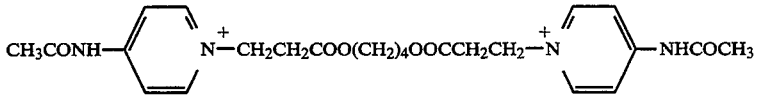

15.0 mg/m$^2$ (c)

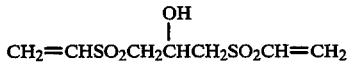

2.0 wt.% with respect to gelatin

Coating of the Protective Layer

A protective layer containing 1.5 g/m$^2$ of gelatin and 0.3 g/m$^2$ of poly(methyl methacrylate) particles (average particle size 2.5 μm) was coated over this layer using the surfactant indicated below.

| Surfactants | |
|---|---|
| 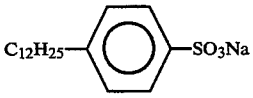 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2N(C_3H_7)CH_2COOK$ | 2.5 mg/m$^2$ |

COMPARATIVE EXAMPLES 2 TO 4

These examples were prepared in the same way as Comparative Example 1 except that the redox compounds 6, 14 and 21 were added a rate of $2.0\times10^{-5}$ mol/m$^2$ in each case to the light-sensitive emulsion layer of Comparative Example 1.

EXAMPLE 1

Gelatin under-layers containing 1.5 g/m$^2$ of gelatin and $2.0\times10^5$ mol/m$^2$ of the redox compounds of the present invention as shown in Table 1 were established between the light-sensitive emulsion layer of Comparative Example 1 and the support to prepare samples 1-1 to 1-8.

These samples were exposed through a contact screen (Fuji Photo Film Co., Ltd., 150 L chain dot type) and an optical wedge using tungsten light of color temperature 3200° K. Then they were developed for 30 seconds at 34° C. in the developer indicated below, fixed for 30 seconds at room temperature by using a fixer GF-1 (made by Fuji Photo Film Co., Ltd.), washed with running water and dried by a warm breeze.

The results obtained on measuring the dot gradation of the samples obtained in Comparative Examples 1 to 4 and Example 1 are shown in Table 1. The screen gradation was expressed by the following equation:

Dot Gradation = Exposure which gave a dot area fraction of 95% (log $E_{95\%}$) − Exposure which gave a dot area fraction of 5% (log $E_{5\%}$)

| Developing Solution | |
|---|---|
| Hydroquinone | 50.0 grams |
| N-Methyl-p-Aminophenol | 0.3 gram |
| Sodium hydroxide | 18.0 grams |
| 5-Sulfosalicylic acid | 55.0 grams |
| Potassium sulfite | 110.0 grams |
| Ethylenediamine tetra-acetic acid disodium salt | 1.0 gram |
| Potassium bromide | 10.0 grams |
| 5-Methylbenzotriazole | 0.4 gram |
| 2-Mercaptobenzimidazole-5-sulfonic acid | 0.3 gram |
| Sodium 3-(5-mercaptotetrazole)benzenesulfonate | 0.2 gram |
| N-n-Butyldiethanolamine | 15.0 grams |

-continued

| Developing Solution | |
|---|---|
| Sodium toluenesulfonate | 8.0 grams |
| Water to make | 1 liter |
| pH adjusted to 11.6 (by adding potassium hydroxide) | pH 11.6 |

-continued

| | |
|---|---|
| Gelatin | 0.5 g/m$^2$ |
| (4) Light-sensitive Layer B: | |
| The light-sensitive emulsion layer of Comparative Example 1 was coated to provide a coated silver weight of 3.4 g/m$^2$. | |

TABLE 1

| Sample | Redox Compound Type | Redox Compound Layer to which Added | Photographic Properties $\bar{G}$* | Photographic Properties Dot Gradation |
|---|---|---|---|---|
| 1 Comp. Ex. 1 | — | — | 14.5 | 1.23 |
| 2 Comp. Ex. 2 | Compound 17 | Light-sensitive Emulsion | 8.3 | 1.38 |
| 3 Comp. Ex. 3 | Compound 34 | Light-sensitive Emulsion | 7.9 | 1.40 |
| 4 Comp. Ex. 4 | Compound 38 | Light-sensitive Emulsion | 7.5 | 1.41 |
| 5 Example 1-1 | Compound 17 | Gelatin Under-layer | 14.0 | 1.45 |
| 6 Example 1-2 | Compound 34 | Gelatin Under-layer | 14.5 | 1.48 |
| 7 Example 1-3 | Compound 38 | Gelatin Under-layer | 13.5 | 1.43 |
| 8 Example 1-4 | Compound 19 | Gelatin Under-layer | 14.0 | 1.45 |
| 9 Example 1-5 | Compound 31 | Gelatin Under-layer | 10.8 | 1.46 |
| 10 Example 1-6 | Compound 33 | Gelatin Under-layer | 11.4 | 1.46 |
| 11 Example 1-7 | Compound 36 | Gelatin Under-layer | 11.7 | 1.47 |
| 12 Example 1-8 | Compound 51 | Gelatin Under-layer | 11.5 | 1.51 |

*: $\bar{G}$ = an inclination of straight line connecting the point of the density 0.3 and the point of the density 3.0 of the characteristic curve.

As is clear from the results of Table 1, in comparison to the comparative examples, the samples of the present invention have a remarkably wide dot gradation. With Comparative Examples 2 to 4 there is a pronounced loss of contrast with $\bar{G}$ less than 10, while high contrast is retained with the samples of the present invention.

Furthermore, the shape of the dots is irregular with roughness in the case of the sample obtained in Comparative Example 1, while with the samples obtained in Comparative Examples 2 to 4 the optical density is low and the dots have a blurred form. On the other hand, with the samples of the present invention the dots have a smooth shape and a high optical density.

EXAMPLE 2

A sample was prepared in the same way as in Example 1 except that a layer whose composition is indicated below was used instead of the gelatin under-layer mentioned in Example 1.

| | |
|---|---|
| Gelatin | 1.5 g/m$^2$ |
| Light-sensitive silver halide emulsion (the light-sensitive emulsion of comparative example 1) as silver | 0.3 g/m$^2$ |
| Redox compound 17 of the invention | $2.0 \times 10^{-5}$ g/m$^2$ |

Good quality dots and a wide dot gradation of 1.40 was obtained on exposing and developing this sample, as in Example 1.

EXAMPLE 3

The following layers were coated sequentially onto a polyester film (150 μm).

| | |
|---|---|
| (1) Light-sensitive Emulsion Layer A: | |
| The light-sensitive emulsion formulation indicated in Comparative Example 1 was coated to provide a coated silver weight of 0.4 g/m$^2$. | |
| (2) Intermediate Layer: | |
| Gelatin | 0.5 g/m$^2$ |
| Poly(ethyl acrylate) latex | 0.15 |
| Redox compound of the present invention | See Table 2 |
| (3) Intermediate Layer: | |
| Gelatin | 0.5 g/m$^2$ |
| (4) Light-sensitive Layer B: | |
| The light-sensitive emulsion layer of Comparative Example 1 was coated to provide a coated silver weight of 3.4 g/m$^2$. | |

The results obtained are shown in Table 2.

TABLE 2

| Sample | Redox Compound Type | Redox Compound Amount Added (mol/m$^2$) | Dot Gradation (ΔlogE) | Dot Quality |
|---|---|---|---|---|
| Comp. Ex. 5 | — | — | 1.19 | 3 |
| Example 3-1 | Compound 17 | $2.1 \times 10^{-5}$ | 1.39 | 4 |
| Example 3-2 | Compound 37 | $2.1 \times 10^{-5}$ | 1.42 | 4 |
| Example 3-3 | Compound 38 | $2.1 \times 10^{-5}$ | 1.41 | 4 |
| Example 3-4 | Compound 19 | $2.1 \times 10^{-5}$ | 1.43 | 4 |
| Example 3-5 | Compound 36 | $2.1 \times 10^{-5}$ | 1.41 | 4 |
| Example 3-6 | Compound 51 | $2.1 \times 10^{-5}$ | 1.45 | 4 |

Dot quality was assessed visually in five levels. The five level evaluation was made in the following way. "5" was the best and "1" was the worst. Results of levels "5" and "4" could be used in practice as screened original plates for photomechanical purposes, results of level "3" were on the edge of practical use, and results of "2" and "1" were of such a quality as to be of no use in practice.

The results were as shown in Table 2. The samples of the present invention provide high dot quality and dot images which have a wide dot gradation.

EXAMPLE 4

An aqueous solution of silver nitrate and an aqueous solution of sodium chloride were mixed simultaneously in an aqueous gelatin solution which was being maintained at 50° C. in the presence of $5.0 \times 10^{-6}$ mol per mol of silver of $(NH_4)_3RhCl_6$. Then, after removing the soluble salts using a method well known in the industry, gelatin was added, and 2-methyl-4-hydroxy-1,3,3a,7-tetra-azaindene was added as stabilizer without chemical ripening. This emulsion (Emulsion B) was a cubic, mono-disperse emulsion of average grain size 0.15 μm.

The compounds of the present invention shown in Table 3 were added, 1,3-vinylsulfonyl-2-propanol was added as a film hardening agent and the emulsions were coated on a polyester support to provide a coated silver weight of 0.4 g/m$^2$. An intermediate layer comprising 0.5 g/m$^2$ of gelatin was coated over the emulsion layer, and then the following light-sensitive layer was coated in such a way as to provide a coated silver weight of 3.4 g/m$^2$.

The following hydrazine compound was added to emulsion B, a poly(ethyl acrylate) latex was added at a rate of 30 wt. % with respect to the gelatin, and 2.0 wt. % with respect to the gelatin of 1,3-divinylsulfonyl-2-propanol was added as a film hardening agent.

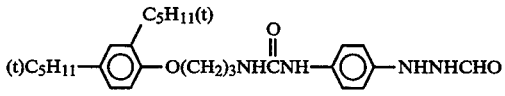

15 mg/m$^2$

Moreover, a layer comprising 1.5 g/m$^2$ of gelatin, 0.3 g/m$^2$ of poly(methyl methacrylate) particles (average particle size 2.5 μm) as matting agent, the surfactants indicated below as coating promotors, and the stabilizer and ultraviolet absorbing dye indicated below was coated as a protective layer over the above mentioned layers and dried.

Surfactants:

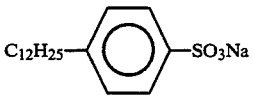

37 mg/m$^2$ $CH_2COOC_6H_{13}$
|
$CHCOOC_6H_{13}$
|
$SO_3Na$ 37 mg/m$^2$ $C_8F_{17}SO_2NCH_2COOK$
|
$C_3H_7$ 2.5 mg/m$^2$

Stabilizer:

Thioctic acid 2.1 mg/m$^2$

Ultraviolet Absorbing Dye 100 mg/m$^2$

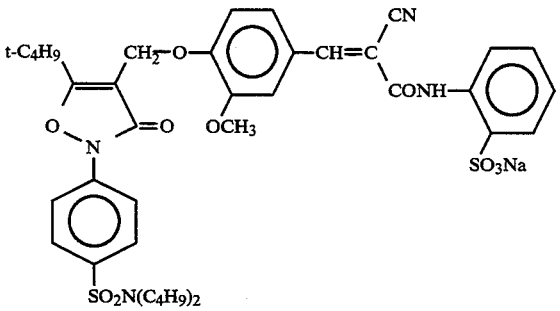

The samples were exposed through an original in a bright room printer P-607 made by the Dainippon Screen Co. as shown in FIG. 1 and developed at 30° C. for 20 seconds, fixed and washed, after which the letter image qualities were evaluated.

A letter image quality of 5 indicates very good quality in that when the proper exposure is made for the original as shown in FIG. 1 a to provide a dot area of 50% on the light-sensitive material for contact work, an image in which letters of width 30 μm are reproduced is obtained. On the other hand, with a letter image quality of 1, the quality is bad in that only letter of width at least 150 μm is reproduced when the proper exposure is given in the same way as before. The appraisal levels 4–2 are established between the aforementioned levels 5 and 1. Only results of level 3 and above are of practical use.

TABLE 3

| Sample | Redox Compound Type | Redox Compound Amount Added (mol/m$^2$) | Letter Image Quality |
|---|---|---|---|
| Comp. Ex. 6 | — | — | 3.0 |
| Example 4-1 | Compound 28 | $5.0 \times 10^{-5}$ | 4.0 |
| Example 4-2 | Compound 38 | $5.0 \times 10^{-5}$ | 4.5 |
| Example 4-3 | Compound 33 | $5.0 \times 10^{-5}$ | 4.5 |
| Example 4-4 | Compound 4 | $7.0 \times 10^{-6}$ | 4.5 |
| Example 4-5 | Compound 41 | $7.0 \times 10^{-6}$ | 4.0 |
| Example 4-6 | Compound 45 | $7.0 \times 10^{-6}$ | 4.5 |
| Example 4-7 | Compound 51 | $5.0 \times 10^{-5}$ | 4.5 |

The results obtained were as shown in Table 3. The samples of this present invention have excellent letter image quality.

EXAMPLE 5

Samples 5-1 to 5-7 were prepared in the same manner as Comparative Example 1 except that the first to fourth layers having the compositions indicated below were coated on the poly(ethylene terephthalate) film support which had a subbing layer comprised of vinylidene chloride copolymer in this order.

| | |
|---|---|
| The first layer: | |
| A light-sensitive emulsion layer same as that of Comparative Example 1. | |
| The second layer: | |
| Gelatin | 1.5 g/m$^2$ |
| The third layer: | |
| Light-sensitive emulsion prepared in the same manner as Comparative Example 1 (mean grain size 0.35 μm) | 0.4 g/m$^2$ as silver |
| 5-methylbenzotriazole | $5 \times 10^{-3}$ mol/mol-Ag |
| 4-hydroxy-1,3,3a,7-tetraazaindene | $2 \times 10^{-3}$ mol/mol-Ag |
| Poly(ethyl acrylate) | 30 wt % to gelatin |
| 1,3-Divinylsulfonyl-2-propanol | 2 wt % to gelatin |
| Redox compound of the invention (shown in Table 4) | $2.0 \times 10^{-5}$ mol/m$^2$ |

The fourth layer:

A protective layer same as that of Comparative Example 1.

These samples were development processed in the same manner as Example 1. For dot quality, the same assessment as Example 3 was applied. The results are shown in Table 4 below.

TABLE 4

| Sample | Redox Compound Type | Redox Compound Layer to which Added | Photographic Properties $\bar{G}$ | Dot Gradation | Dot Quality |
|---|---|---|---|---|---|
| 1 Example 5-1 | Compound 17 | The Third Layer | 13.3 | 1.43 | 5 |
| 2 Example 5-2 | Compound 35 | The Third Layer | 12.7 | 1.42 | 5 |
| 3 Example 5-3 | Compound 38 | The Third Layer | 13.5 | 1.42 | 5 |
| 4 Example 5-4 | Compound 19 | The Third Layer | 12.5 | 1.43 | 5 |

TABLE 4-continued

| Sample | Redox Compound Type | Redox Compound Layer to which Added | Photographic Properties $\bar{G}$ | Dot Gradation | Dot Quality |
|---|---|---|---|---|---|
| 5 Example 5-5 | Compound 31 | The Third Layer | 13.0 | 1.42 | 5 |
| 6 Example 5-6 | Compound 33 | The Third Layer | 12.0 | 1.42 | 5 |
| 7 Example 5-7 | Compound 34 | The Third Layer | 13.5 | 1.43 | 5 |

From the results of Table 4, it is clear that the samples of the present invention have wide dot gradation and superhigh contrast of a gamma value of more than 10. Further, the dots have a smooth shape and a high optical density.

EXAMPLE 6

Samples 6-1 to 6-5 were prepared in the same manner as Example 5 except that the compounds shown below were used in a mixture as a hydrazine derivative and the redox compound was changed as shown in Table 5 below.

| Hydrazine derivative: | |
|---|---|
| Compound II-5 | $1.8 \times 10^{-5}$ mol/m$^2$ |
| Compound II-19 | $3.7 \times 10^{-6}$ mol/m$^2$ |

These samples were development processed in the same manner as Example 1.

TABLE 5

| Sample | Redox Compound Type | Amount Added (mol/m$^2$) | Dot Gradation (ΔlogE) | Dot Quality |
|---|---|---|---|---|
| Example 6-1 | Compound 17 | $4.8 \times 10^{-5}$ | 1.37 | 5 |
| Example 6-2 | Compound 37 | $4.8 \times 10^{-5}$ | 1.39 | 5 |
| Example 6-3 | Compound 38 | $4.8 \times 10^{-5}$ | 1.39 | 5 |
| Example 6-4 | Compound 19 | $4.8 \times 10^{-5}$ | 1.41 | 5 |
| Example 6-5 | Compound 36 | $4.8 \times 10^{-5}$ | 1.38 | 5 |

The resutls are shown in Table 5. The samples of the present invention provide high dot quality and dot images which have a wide dot gradation.

EXAMPLE 7

The first to fourth layers each having the composition indicated below were coated on the polyester support used in Example 4 in this order.

| | |
|---|---|
| First layer: | |
| Light-sensitive emulsion B prepared in Example 4 | |
| Hydrazine compound II-30 | 75 mg/m$^2$ |
| 5-Methylbenzotriazole | $5 \times 10^{-3}$ mol/mol-Ag |
| Polyethyl acrylate latex | 30 wt % to gelatin |
| 1,3-Divinylsulfonyl-2-propanol | 20 wt % to gelatin |
| The coated silver weight of this layer was 3.5 g/m$^2$. | |
| The second layer: | |
| Gelatin | 1.0 g/m$^2$ |
| The third layer: | |
| Light-sensitive emulsion prepared in the same manner as Emulsion B of Example 4 (mean grain size 0.27 μm) | 0.2 g/m$^2$ as silver |
| 5-Methylbenzotriazole | $5 \times 10^{-3}$ mol/mol-Ag |
| Poly(ethyl acrylate) | 30 wt % to gelatin |
| 1,3-Divinylsulfonyl-2-propanol | 2 wt % to gelatin |
| Redox compound of the invention (shown in Table 6) | |

The fourth layer:

A protective layer same as that of Example 4.

These samples were development processed and evaluated in the same manner as Example 4. The results are shown in Table 6 below.

TABLE 6

| Sample | Redox Compound Type | Redox Compound Amount Added (mol/m$^2$) | Letter Image Quality |
|---|---|---|---|
| Example 7-1 | Compound 17 | $5.0 \times 10^{-5}$ | 4.5 |
| Example 7-2 | Compound 34 | $5.0 \times 10^{-5}$ | 5.0 |
| Example 7-3 | Compound 35 | $5.0 \times 10^{-5}$ | 5.0 |
| Example 7-4 | Compound 4 | $7.0 \times 10^{-6}$ | 4.5 |
| Example 7-5 | Compound 41 | $7.0 \times 10^{-6}$ | 4.0 |
| Example 7-6 | Compound 45 | $7.0 \times 10^{-6}$ | 4.0 |

As is clear from the results of Table 6, the samples of the present invention have excellent letter image quality.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises (a) a support having thereon (b1) at least one light-sensitive silver halide emulsion layer containing a hydrazine derivative having an —N—N— linkage and (b2) a hydrophilic colloid layer which is different from said light-sensitive silver halide emulsion layer and which contains a redox compound according to the following formula (I) which has a hydrazine group as the redox group and which is capable of releasing a development inhibitor:

$$R-\underset{A_1}{N}-\underset{A_2}{N}-V-(Time)_t-PUG \qquad (I)$$

wherein both $A_1$ and $A_2$ represent hydrogen atoms, or one represents a hydrogen atom and the other represents a sulfinic acid residual group or $$-\underset{\underset{O}{\|}}{(C)_l}-R_0$$

(wherein $R_0$ represents an alkyl group, an alkenyl group, an aryl group, an alkoxy group or an aryloxy group, and l represents 1 or 2);

Time represents a divalent linking group; t represents 0 or 1; PUG represents a development inhibitor; V represents a carbonyl group, $$-\underset{\underset{O}{\|}}{C}-\underset{\underset{O}{\|}}{C}-,$$

a sulfonyl group, a sulfoxy group,

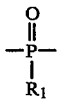

(wherein $R_1$ represents an alkoxy group or an aryloxy group), an iminomethylene group or a thiocarbonyl group; and R represents an aliphatic group, an aromatic group or a heterocyclic group; wherein said at least one light-sensitive silver halide emulsion layer containing a hydrazine derivative is positioned between the support and the redox compound-containing hydrophilic colloid layer.

2. A silver halide photographic material as in claim 1, wherein both $A_1$ and $A_2$ are hydrogen atoms.

3. A silver halide photographic material as in claim 1, wherein one of $A_1$ and $A_2$ is a hydrogen atom and the other is a sulfinic acid residual group.

4. A silver halide photographic material as in claim 1, wherein one of $A_1$ and $A_2$ is a hydrogen atom and the other is

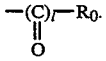

5. A silver halide photographic material as in claim 1, wherein t is 0.

6. A silver halide photographic material as in claim 1, wherein t is 1.

7. A silver halide photographic material as in claim 1, wherein V represents a carbonyl group.

8. A silver halide photographic material as in claim 1, wherein V represents

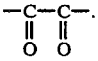

9. A silver halide photographic material as in claim 1, wherein V represents a sulfonyl group.

10. A silver halide photographic material as in claim 1, wherein V represents a sulfoxy group.

11. A silver halide photographic material as in claim 1, wherein V represents

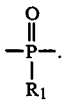

12. A silver halide photographic material as in claim 1, wherein V represents an iminomethylene group.

13. A silver halide photographic material as in claim 1, wherein V represents an thiocarbonyl group.

14. A silver halide photographic material as in claim 1, wherein R represents an aliphatic group.

15. A silver halide photographic material as in claim 1, wherein R represents an aromatic group.

16. A silver halide photographic material as in claim 1, wherein R represents a heterocyclic group.

* * * * *